US009927143B2

(12) United States Patent
Naitoh et al.

(10) Patent No.: US 9,927,143 B2
(45) Date of Patent: Mar. 27, 2018

(54) BURNER, COMBUSTION APPARATUS, WATER HEATING APPARATUS AND COMBUSTION METHOD

(71) Applicant: PURPOSE CO., LTD., Fuji-shi, Shizuoka (JP)

(72) Inventors: Katsumi Naitoh, Fuji (JP); Yoshiaki Sano, Fuji (JP)

(73) Assignee: PURPOSE CO., LTD., Fuki-shi (JP)

( * ) Notice: Subject to any disclaimer, the term of this patent is extended or adjusted under 35 U.S.C. 154(b) by 192 days.

(21) Appl. No.: 14/606,185

(22) Filed: Jan. 27, 2015

(65) Prior Publication Data

US 2015/0253035 A1 Sep. 10, 2015

(30) Foreign Application Priority Data

Mar. 4, 2014 (JP) ..... 2014-041443

(51) Int. Cl.
*F24H 1/14* (2006.01)
*F23D 14/02* (2006.01)
(Continued)

(52) U.S. Cl.
CPC ..... *F24H 1/145* (2013.01); *F23D 14/02* (2013.01); *F23D 14/586* (2013.01); *F23D 14/60* (2013.01);
(Continued)

(58) Field of Classification Search
CPC ..... F23D 14/02; F23D 14/46; F23D 14/58; F23D 14/60; F23D 14/84
See application file for complete search history.

(56) References Cited

U.S. PATENT DOCUMENTS 5,318,438 A * 6/1994 Sugahara ..... F23D 14/045 126/92 R
5,525,054 A * 6/1996 Nakaura ..... F23D 14/045 431/285
(Continued)

FOREIGN PATENT DOCUMENTS

JP 7-103420 A 4/1995
JP 2003-269705 A 9/2003
(Continued)

OTHER PUBLICATIONS

Office Action dated Oct. 24, 2017, issued in counterpart Japanese Application No. 2014-041443, with partial English translation. (8 pages).

*Primary Examiner* — Nathaniel Herzfeld
(74) *Attorney, Agent, or Firm* — Westerman, Hattori, Daniels & Adrian, LLP

(57) ABSTRACT

A burner includes a first burner port that generates a first flame, a gap that surrounds the first burner port, and a plurality of second burner ports that are disposed on either side of the gap, the second burner ports generating second flames to hold the first flame. The first burner port combusts a first mixture (lean mixture) to generate the first flame (lean flame). The first mixture includes air more than fuel gas. A gap that surrounds the first burner port is formed. A plurality of the second burner ports are arranged on either side of the gap. The second burner ports combust a second mixture (rich mixture) to generate the second flames (rich flames) and hold the first flame. The air-fuel ratio of the second mixture is smaller than the first mixture.

12 Claims, 21 Drawing Sheets

(51) Int. Cl.

| | |
|---|---|
| ***F23D 14/60*** | (2006.01) |
| ***F23D 14/84*** | (2006.01) |
| ***F23D 14/58*** | (2006.01) |
| ***F23D 14/64*** | (2006.01) |
| ***F24H 9/20*** | (2006.01) |

(52) U.S. Cl.
CPC ..... *F23D 14/64* (2013.01); *F23D 14/84* (2013.01); *F24H 9/2035* (2013.01); *F23C 2201/20* (2013.01); *F23C 2900/06043* (2013.01); *F24D 2220/044* (2013.01)

(56) References Cited

U.S. PATENT DOCUMENTS

| | | | | |
|---|---|---|---|---|
| 2012/0219920 | A1* | 8/2012 | Akiyama | F23D 14/586<br>431/278 |
| 2012/0244482 | A1* | 9/2012 | Homma | F23D 14/46<br>431/278 |
| 2012/0308945 | A1* | 12/2012 | Wada | F23C 6/02<br>431/278 |
| 2013/0247844 | A1* | 9/2013 | Cheng | F23D 14/045<br>122/18.4 |

FOREIGN PATENT DOCUMENTS

| | | | |
|---|---|---|---|
| JP | 2004-3767 | A | 1/2004 |
| JP | 2010-261615 | A | 11/2010 |

* cited by examiner

BURNER, COMBUSTION APPARATUS, WATER HEATING APPARATUS AND COMBUSTION METHOD

CROSS-REFERENCE TO RELATED APPLICATIONS

This application is entitled to the benefit of priority of Japanese Patent Application No. 2014-041443, filed on Mar. 4, 2014, the contents of which are hereby incorporated by reference.

BACKGROUND OF THE INVENTION i) Field of the Invention

The present invention relates to combustion technology of burners and the like that combust fuel gas.

ii) Description of the Related Art

Upon gas combustion, air has a high ratio to fuel gas in a lean mixture and a low ratio in a rich mixture. In combustion of lean mixtures, nitrogen oxides (NOx) in combustion exhaust gases can be less but the combustion is not stable. On the contrary, in combustion of rich mixtures, the combustion is stable. It is known in view of their characteristics to improve the stability of combustion together with to reduce NOx, and to hold flame in lean mixtures by flame in rich mixture.

Concerning such gas combustion, it is known that thick flame holes disposed at both sides of thin flame holes of a burner form retention flame and this retention flame retains the main flame on the thin flame holes side (for example, Japanese Unexamined Patent Application Publication No. 2010-261615).

BRIEF SUMMARY OF THE INVENTION

Burners that combust fuel gas include, what is called, press burners that are formed by press working of metallic plates. A burner port unit of such a press burner is shaped by a metallic plate. Lean flame burner ports are arranged in the middle of a burner and rich flame burner ports are arranged on the sides of the lean flame burner ports. Lean mixtures flow out of the lean flame burner ports to be combusted. On the contrary, rich mixtures flow out of the rich flame burner ports to be combusted. Laminated structure of plural metallic plates forms plural burner ports in the case of a burner where rich flame burner ports are formed on either side of lean flame burner ports. Thus, there is a problem of limiting shapes and arrangement of burner ports because of shaping of metallic plates.

When the lean flame burner ports are arranged in the middle of a burner and the rich flame burner ports are arranged on either side of the lean flame burner ports, the rich flame burner ports result in being apart from the lean flame burner ports while the effect of holding flame is obtained in the area where the rich flame burner ports are arranged. Therefore, the effect of holding lean combustion flame by rich combustion flame lessens. The lean flame burner ports have a low-level function of holding flame in its vertical and diagonal directions, and combustion on the lean combustion flame side is unstable.

Combustion of lean mixtures that flow out of the lean flame burner ports forms the main flame. It is not possible to form stable flame in case of an extremely low lean/rich ratio, excess air and the lack of air for combustion on this main flame side. Therefore, a combustion control zone available is narrowed to keep stable combustion. As a result, excess carbon monoxide (CO) and NOx are emitted, and there is no margin in the combustion specifications for combustion exhaust gases even if the standards of combustion exhaust gases are met.

In view of the above problems, a first object of the present invention is to achieve the reduction of CO and NOx, and to improve the function of holding lean flame to achieve the stability of the combustion.

In view of the above problems, a second object of the present invention is to achieve the reduction of CO and NOx and the stability of the combustion to improve the controllability of the combustion.

According to the burner that is an aspect of the present invention, the burner includes first and second burner ports, and a gap between the first and second burner ports. On the first burner port, a first mixture is combusted to generate a first flame. The gap surrounds the first burner port. The second burner ports are arranged on either side of the gap and combust a second mixture, to generate second flames and hold the first flame.

Additional objects and advantages of the present invention will be apparent from the following detailed description of the invention thereof, which are best understood with reference to the accompanying drawings.

Figure 10:
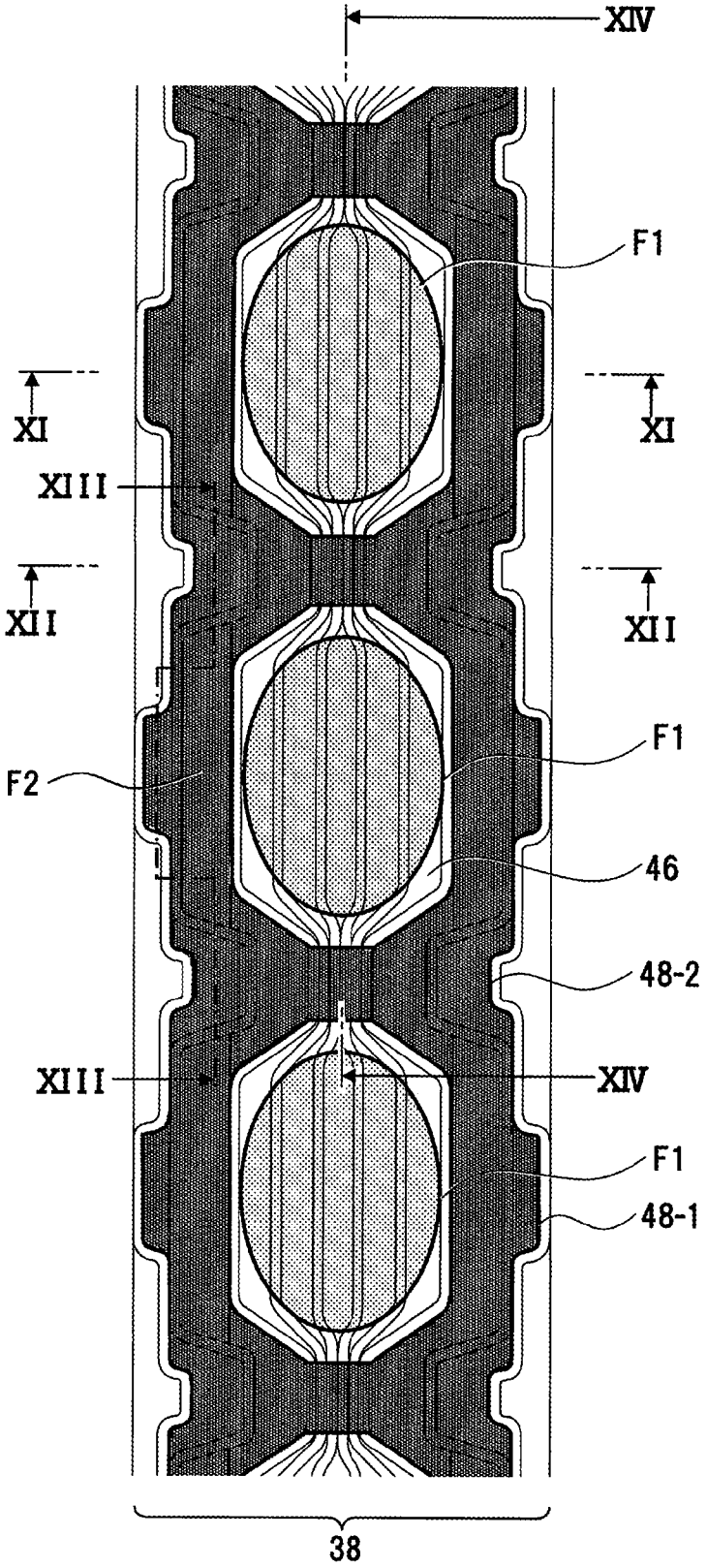
FIG. 10 is a plan view for illustrating lean flame and rich flame of a burner.
Figure 12:
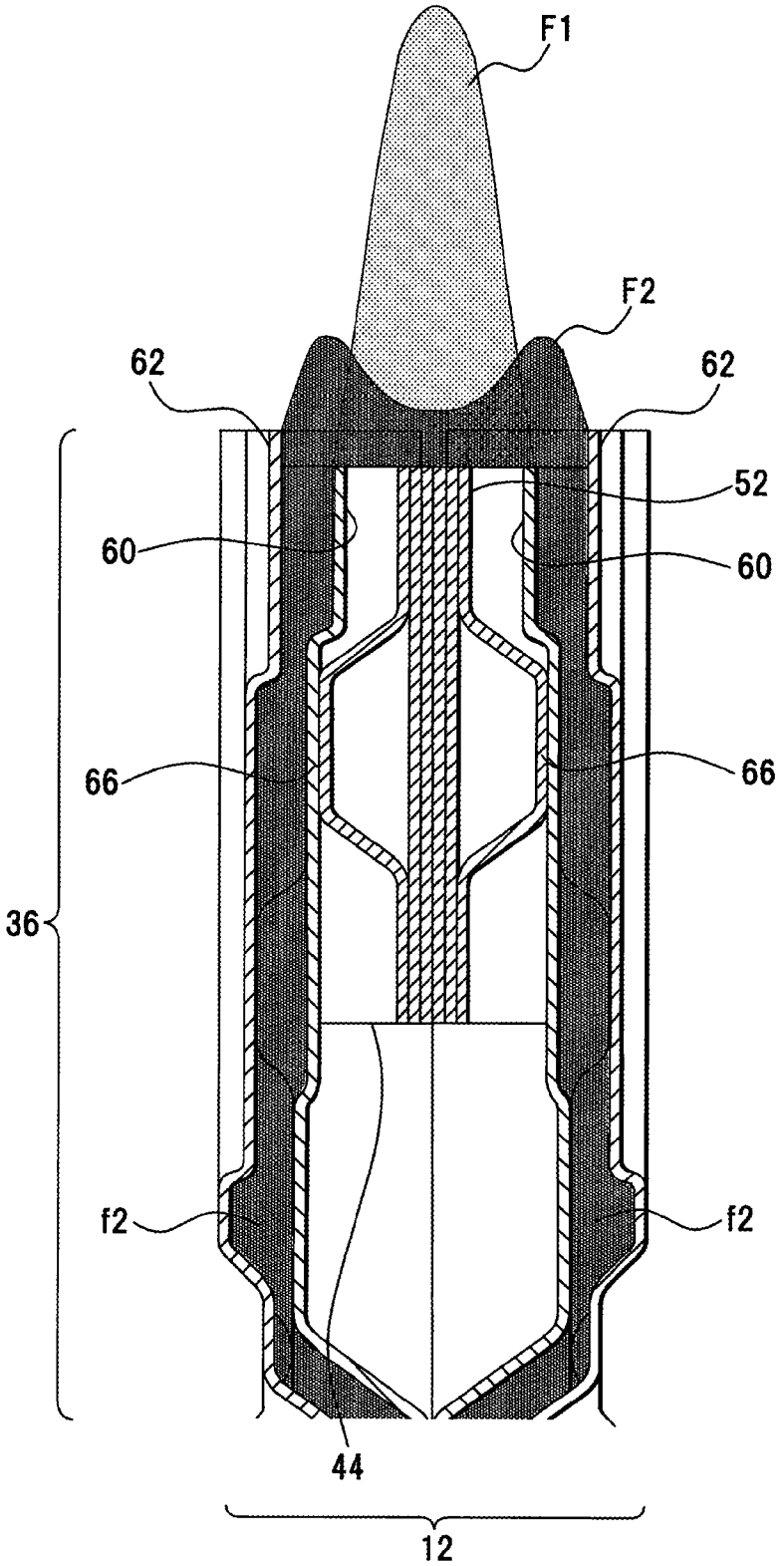
Figure 13:
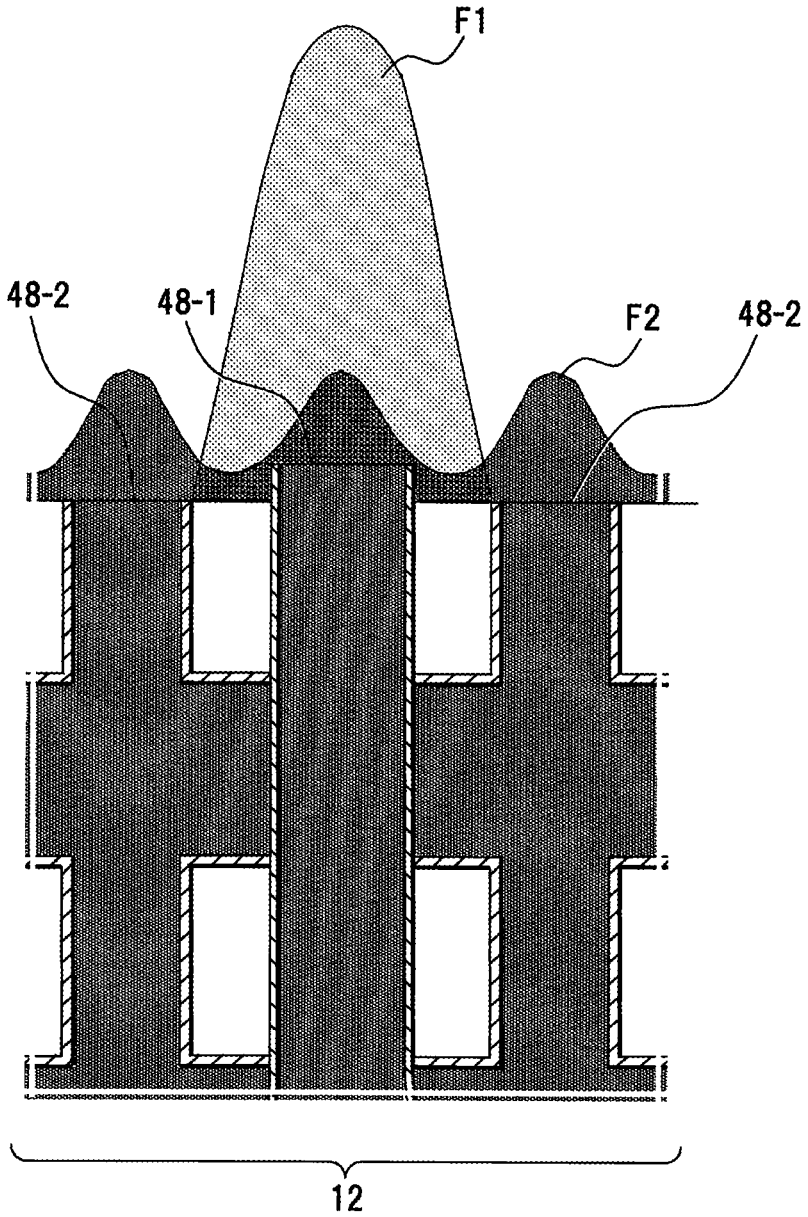
Figure 14:
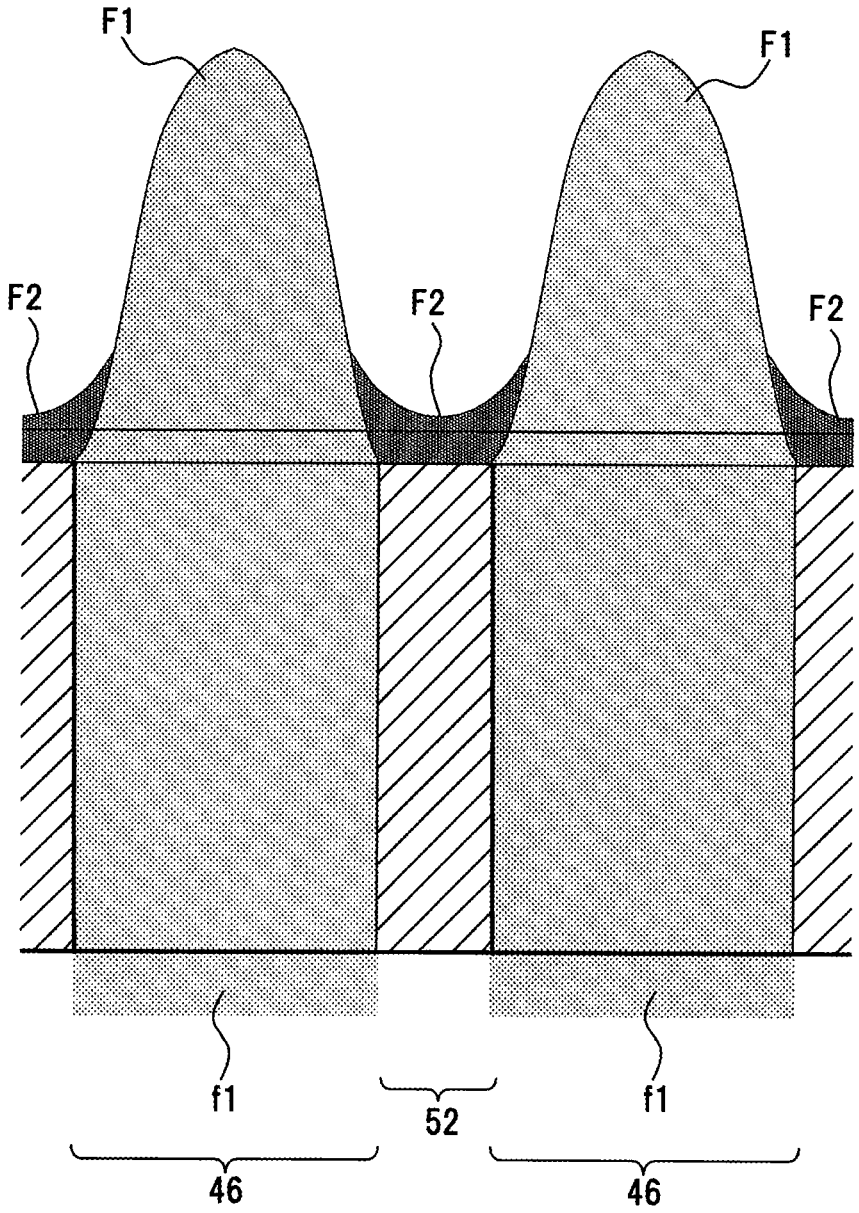
Figure 15:
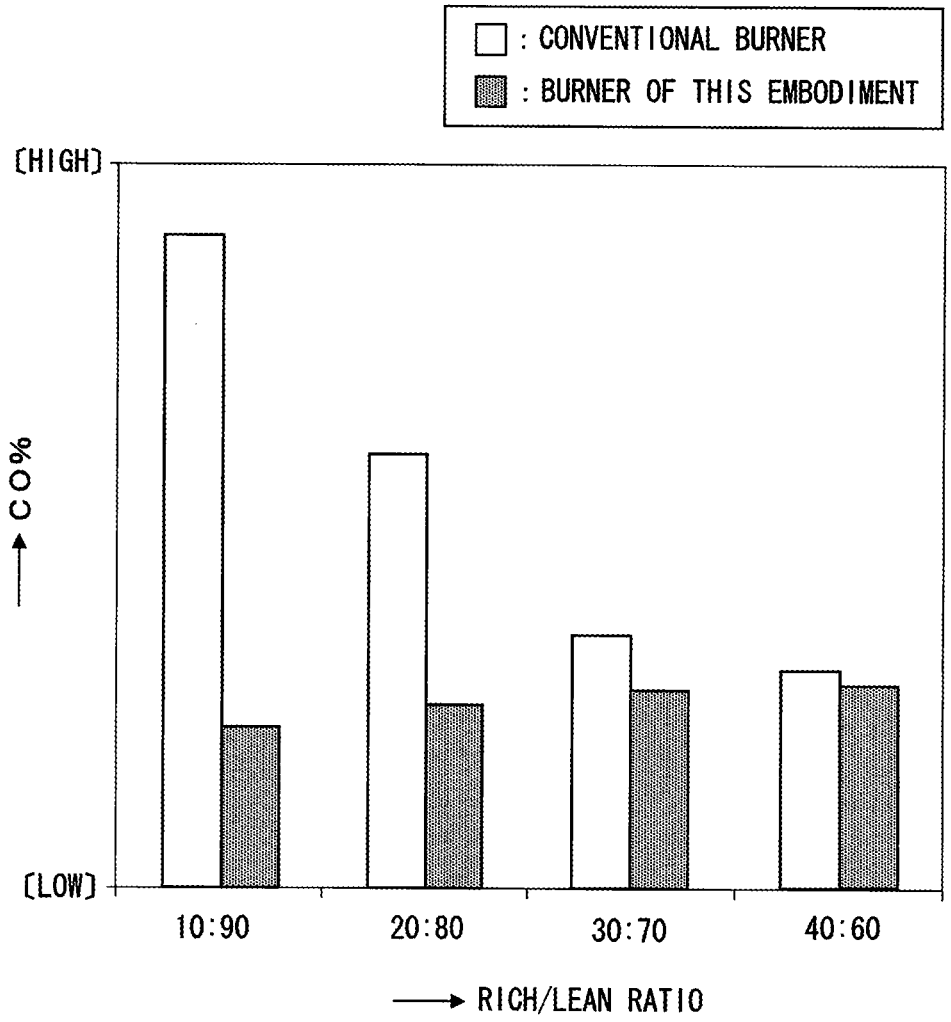
Figure 16:
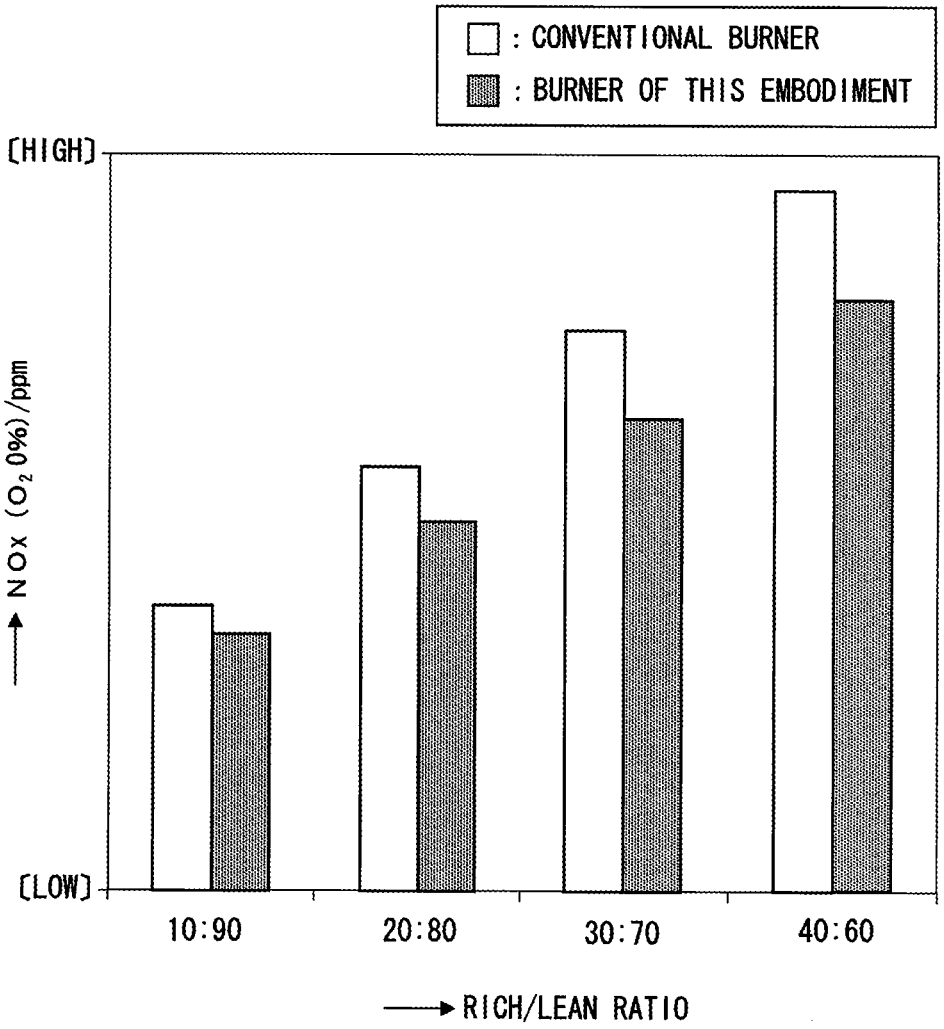
Figure 17:
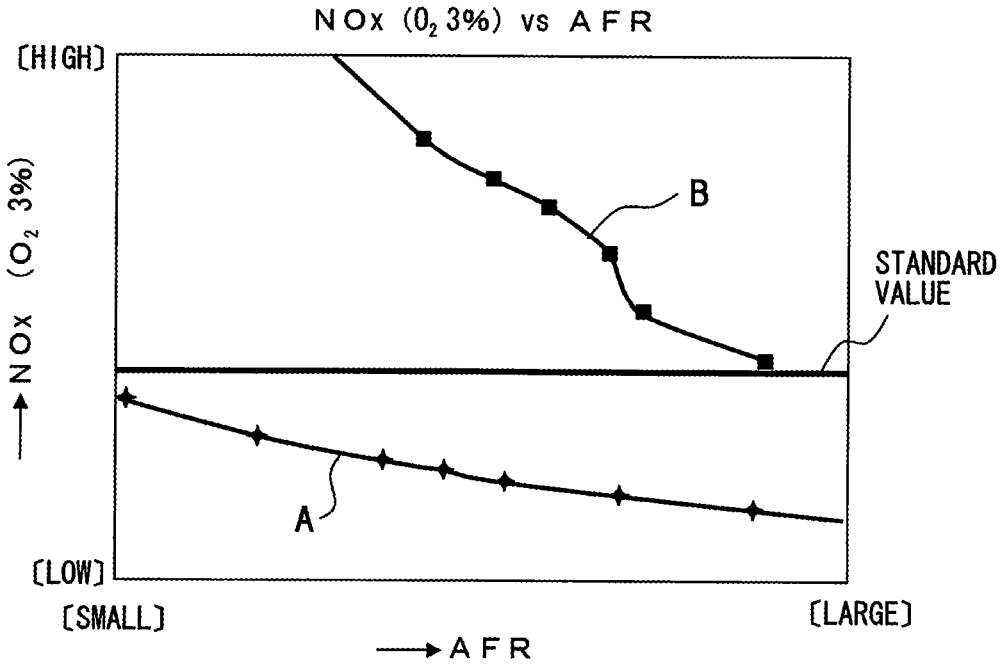
Figure 18:
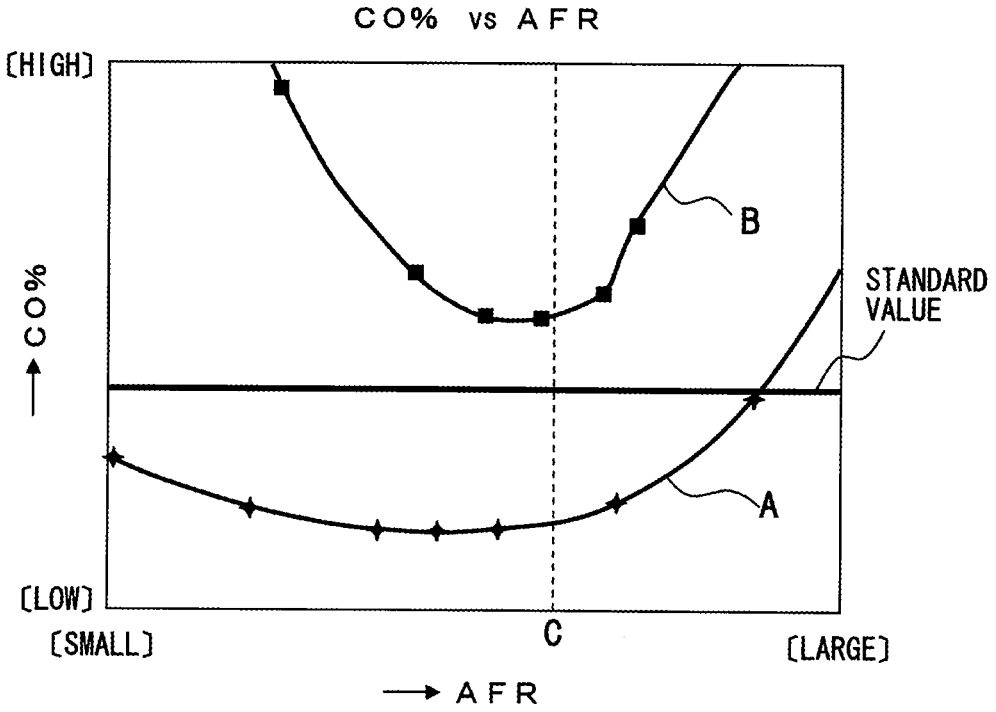
Figure 19A:
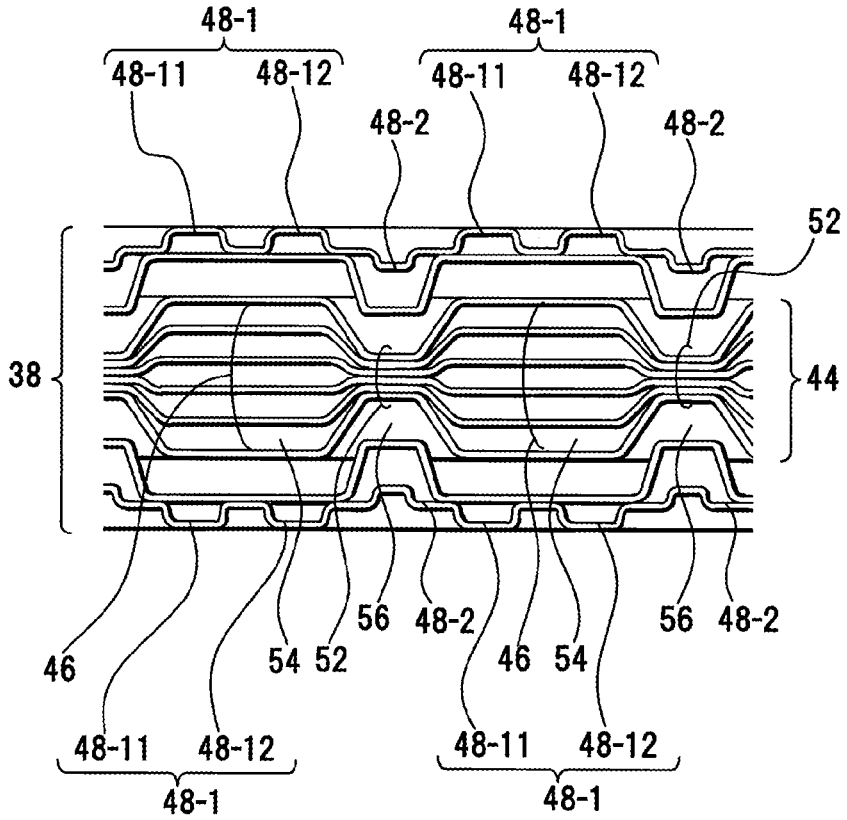
Figure 19B:
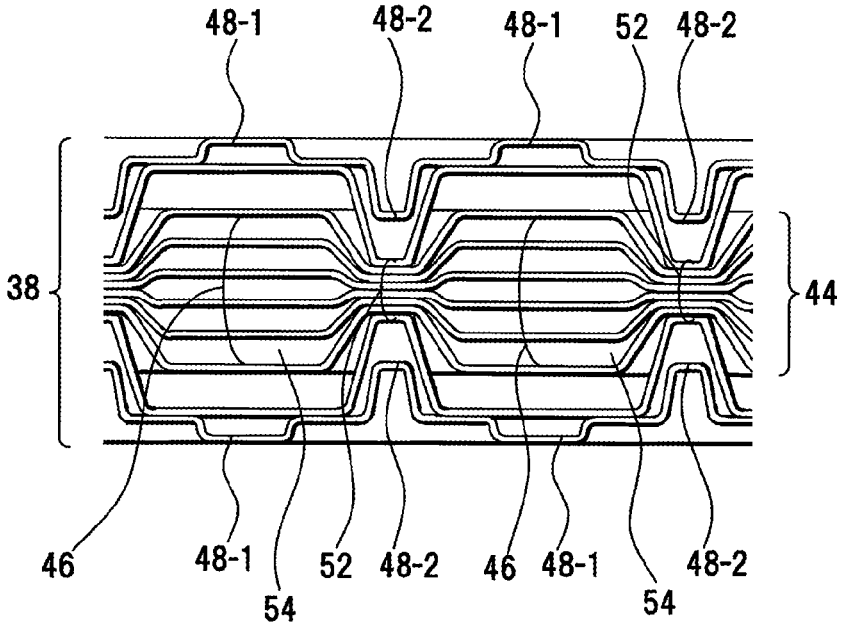
Figure 20:
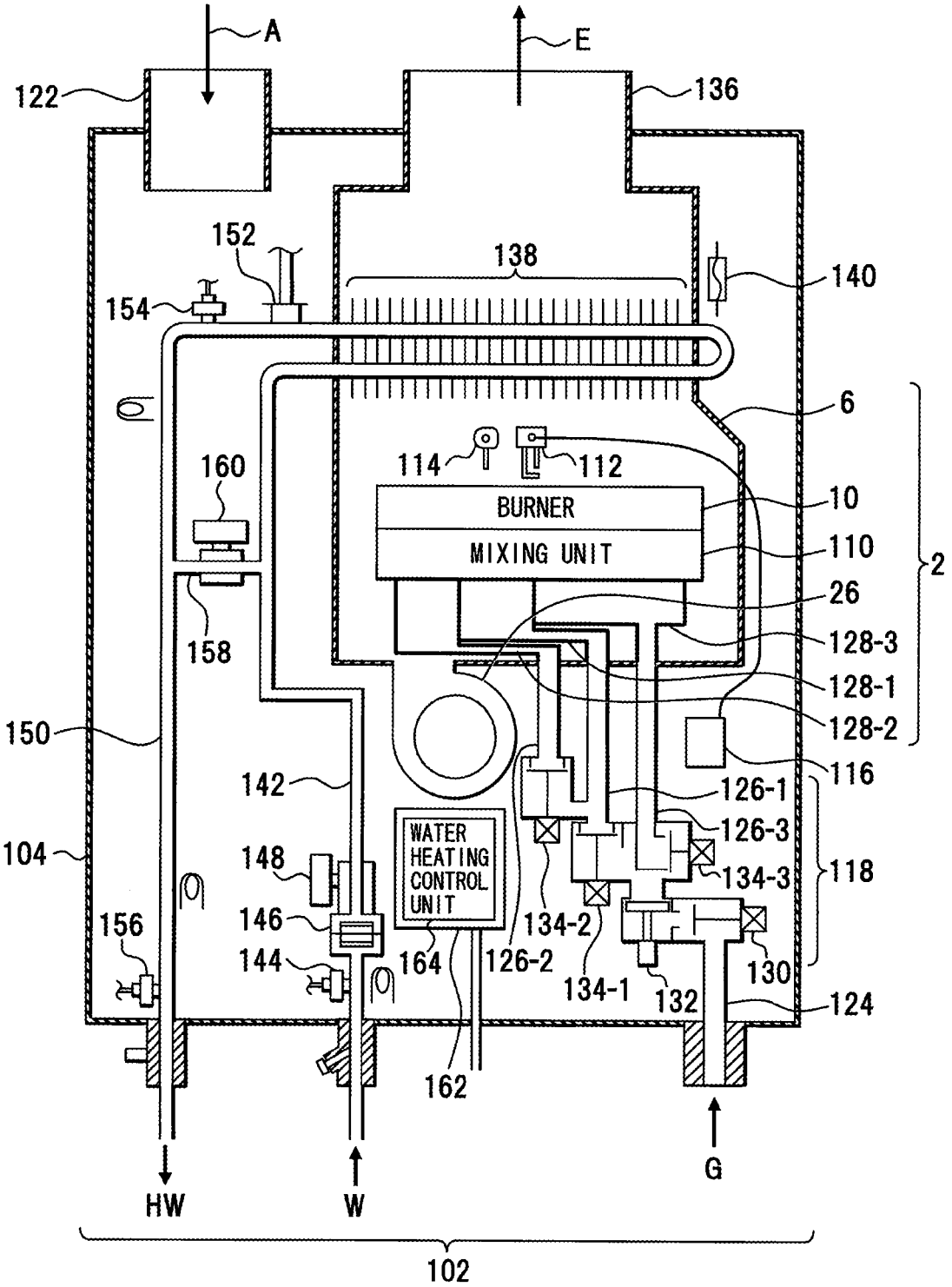
Figure 21:
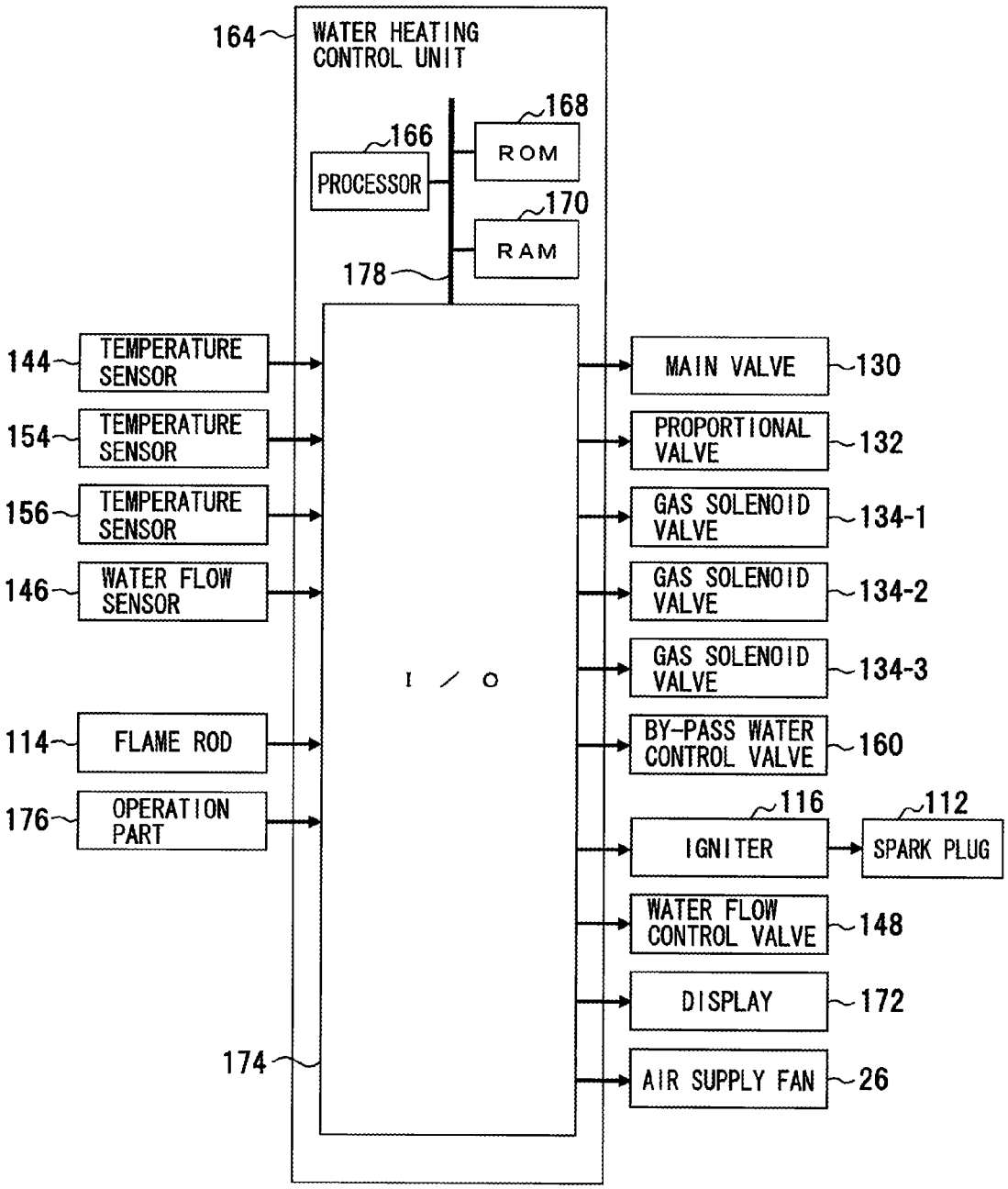

XI-XI of FIG. 10 for illustrating lean flame and rich flame;

FIG. 12 is an end view depicting a cross-section taken along the line XII-XII of FIG. 10 for illustrating lean flame and rich flame;

FIG. 13 is an end view depicting a cross-section taken along the line XIII-XIII of FIG. 10 for illustrating lean flame and rich flame;

FIG. 14 is an end view depicting an end taken along the line XIV-XIV of FIG. 10 for illustrating lean flame;

FIG. 15 depicts the relationship between the lean/rich ratio of combustion gas and CO %;

FIG. 16 depicts the relationship between the lean/rich ratio of combustion gas and NOx;

FIG. 17 depicts changing NOx according to difference of the lean/rich ratio;

FIG. 18 depicts the relationship between burner port loads and CO %;

FIGS. 19A and 19B depict variations of a burner port unit of the burner unit;

FIG. 20 depicts an example of a water heating apparatus according to the second embodiment; and FIG. 21 depicts an example of a water heating control unit.

DETAILED DESCRIPTION OF THE INVENTION

First Embodiment

<Combustion Apparatus>

Figure 1:
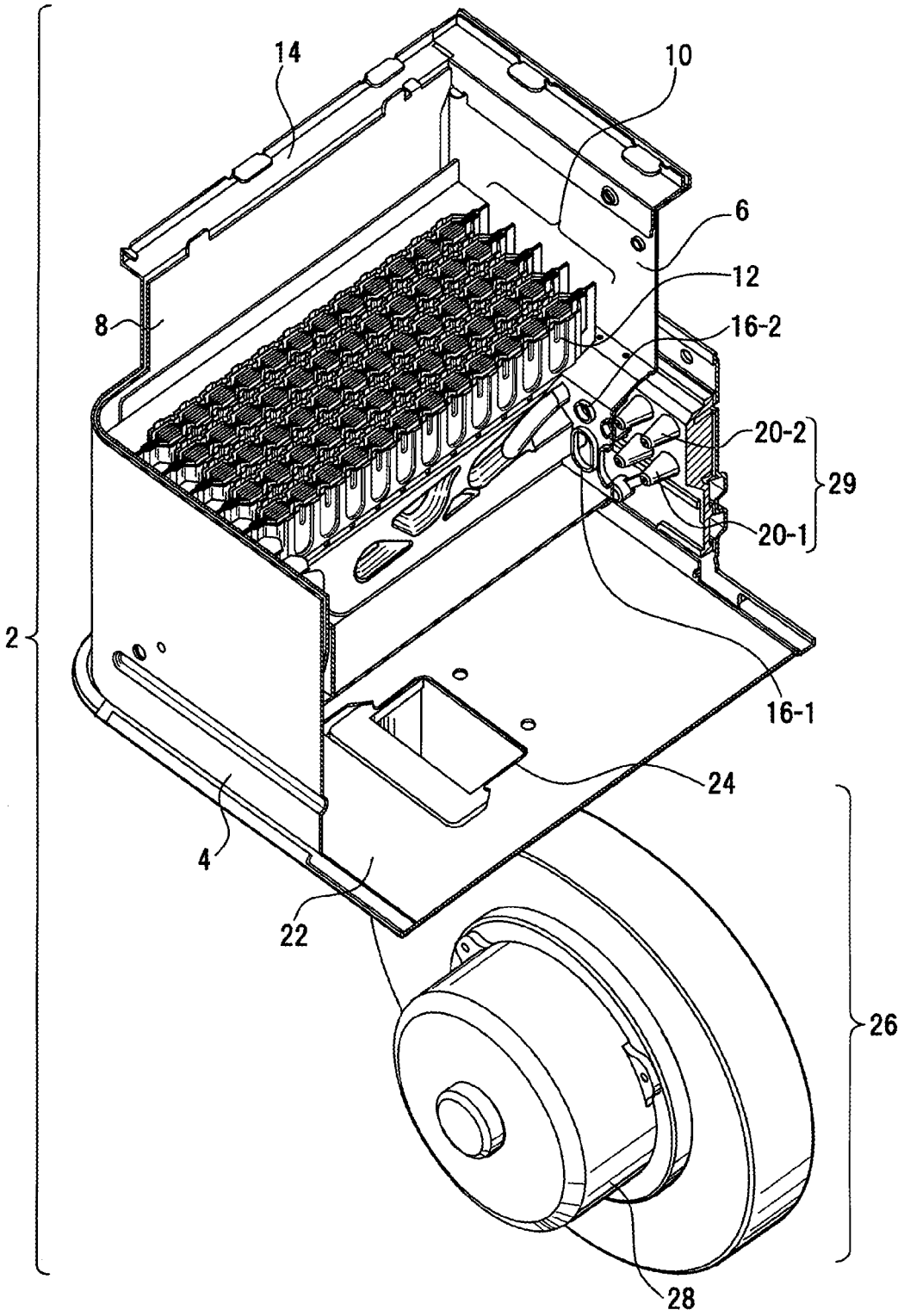
FIG. 1 is a perspective view depicting a partially cutout combustion apparatus according to the first embodiment.

FIG. 1 depicts a partially cutout combustion apparatus according to the first embodiment. This combustion apparatus 2 is an example of the combustion apparatus of the present invention.

The combustion apparatus 2 is used as a heat source machine for water heating apparatus and space and water heating apparatus that use fuel gas and the like as fuel. The combustion apparatus 2 includes an apparatus housing 4. A combustion chamber 6 is formed in the apparatus housing 4. The combustion chamber 6 is encompassed by a side wall part 8 of the apparatus housing 4. A burner 10 that combusts fuel gas is disposed in the combustion chamber 6. The burner 10 includes a plurality of burner units 12. For example, a uniform burner port surface is formed over the burner 10.

A support part 14 is formed on the top of the side wall part 8 as protruding outside along the combustion chamber 6. A heat exchanger, which is not depicted, is disposed on the top surface of the support part 14. Heat of combustion exhaust that is obtained by combustion of fuel gas is exchanged in the heat exchanger.

A plurality of first fuel supply ports 16-1 and second fuel supply ports 16-2 are formed on the side wall part 8 of the apparatus housing 4. The fuel supply ports 16-1 are openings for supplying fuel gas toward lean flame burner ports that are the first burner ports of the burner units 12. The fuel supply ports 16-2 are openings for supplying fuel gas toward rich flame burner ports that are the second burner ports of the burner units 12.

A common fuel supply unit 18 is disposed outside the fuel supply ports 16-1 and 16-2. The fuel supply unit 18 is equipped with a plurality of first fuel injection nozzles 20-1 and second fuel injection nozzles 20-2. The first fuel injection nozzles 20-1 are arranged at the side of the fuel supply ports 16-1, and the second fuel injection nozzles 20-2 are arranged at the side of the fuel supply ports 16-2. Fuel gas is supplied to the inside the burner units 12. In this example, the fuel supply ports 16-1 are ovals and the fuel supply ports 16-2 are circles. The area of opening of each fuel supply port 16-1 is larger than that of each fuel supply port 16-2. These areas of openings differentiate the amount of entering air to the supply of fuel gas. Thereby, a lean mixture that is a first air-fuel mixture is generated at the side of the fuel supply ports 16-1 and a rich mixture that is a second air-fuel mixture is generated at the side of the fuel supply ports 16-2. That is, the first air-fuel mixture generates the first flame and the second air-fuel mixture generates the second flame.

The density of fuel gas to the amount of the air is different between a lean mixture and a rich mixture in comparison. That is, the air/fuel ratio is different between a lean mixture and a rich mixture. A lean mixture is an air-fuel mixture where the amount of air to fuel gas is large and fuel gas is lean. A rich mixture is an air-fuel mixture where the amount of air to fuel gas is small and fuel gas is rich. In this case, a lean mixture is the main air-fuel mixture for combustion and a rich mixture only holds flame of the main air-fuel mixture for combustion. Thus, the amount of fuel gas, which is included in an air-fuel mixture, is larger in a lean mixture than a rich mixture.

The bottom of the apparatus housing 4 is covered by a bottom plate 22. An air inlet 24 is formed on the bottom plate 22. An air supply fan 26 is disposed below the lower face of the bottom plate 22. The air supply fan 26 is coupled with the air inlet 24. The air supply fan 26 is equipped with a motor 28. The rotation of the motor 28 supplies combustion air from the air supply fan 26 to the air inlet 24. This combustion air is entered into the burner units 12 according to the injection of fuel gas, to be used for the combustion of the fuel gas.

Figure 2:
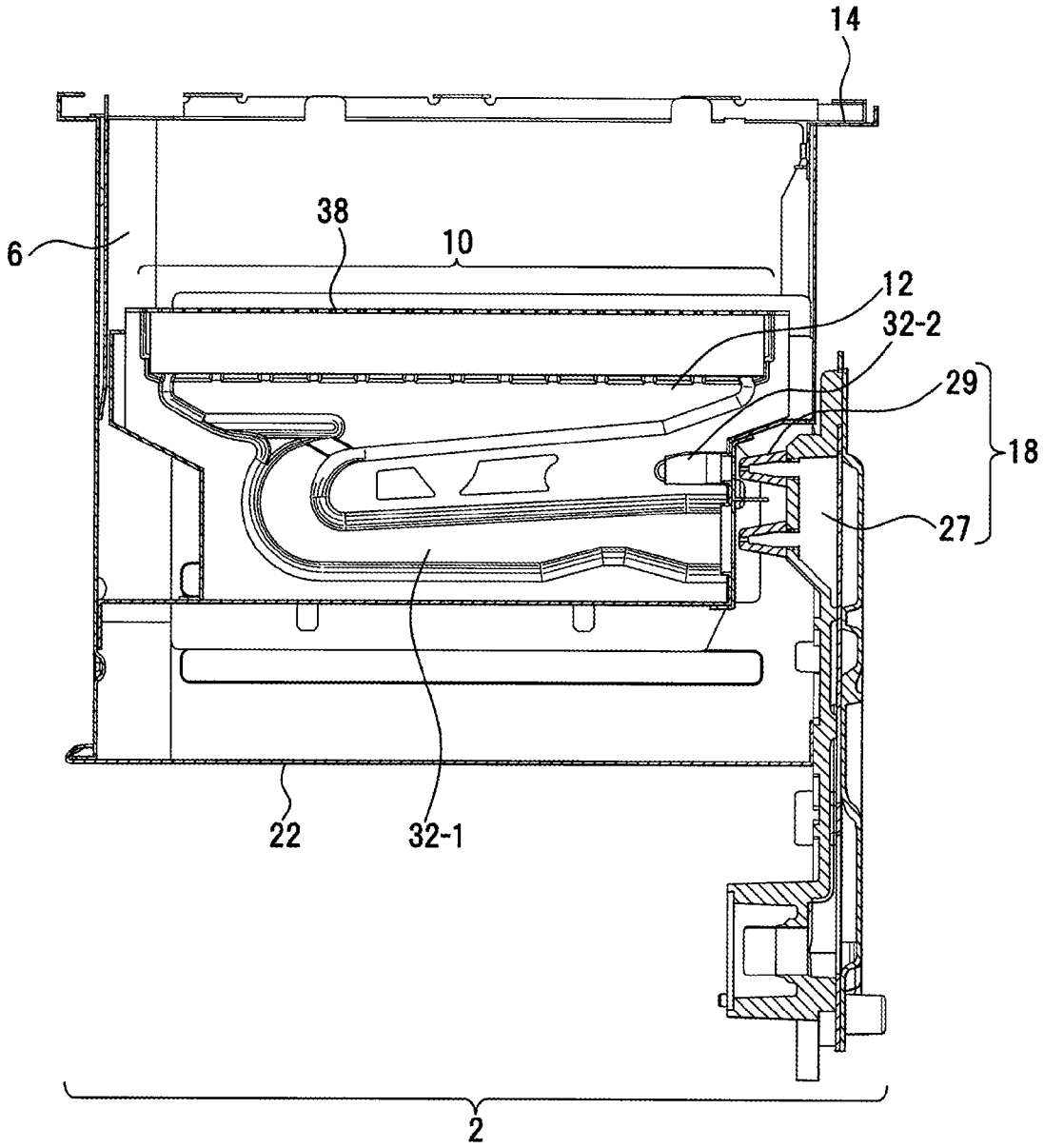
FIG. 2 is a longitudinal cross-sectional view depicting the combustion apparatus.

FIG. 2 depicts a vertical cross-section of the combustion apparatus 2. The burner units 12 are arranged inside the apparatus housing 4 in such a way that a burner ports part 38 (FIG. 5) of each thereof comes on its top surface. The burner units 12 are independently equipped with mixing units 32-1 and 32-2. Fuel gas supplied from the fuel injection nozzles 20-1 and combustion air are mixed in the mixing unit 32-1, to form a lean mixture. Fuel gas supplied from the fuel injection nozzles 20-2 and combustion air are mixed in the mixing unit 32-2, to form a rich mixture.

A fuel supply chamber 27 is formed in the apparatus housing 4 in such a way that part of the side wall part 8, which is the side of the fuel supply ports 16-1 and 16-2, is depressed toward the inside of the apparatus housing 4. The fuel supply unit 18 is disposed at the fuel supply chamber 27. A nozzle body 29 of the fuel supply unit 18 closes the fuel supply chamber 27. The fuel supply unit 18 is housed in the side wall part 8. Thus, the compact apparatus housing 4 is achieved.

Figure 3:
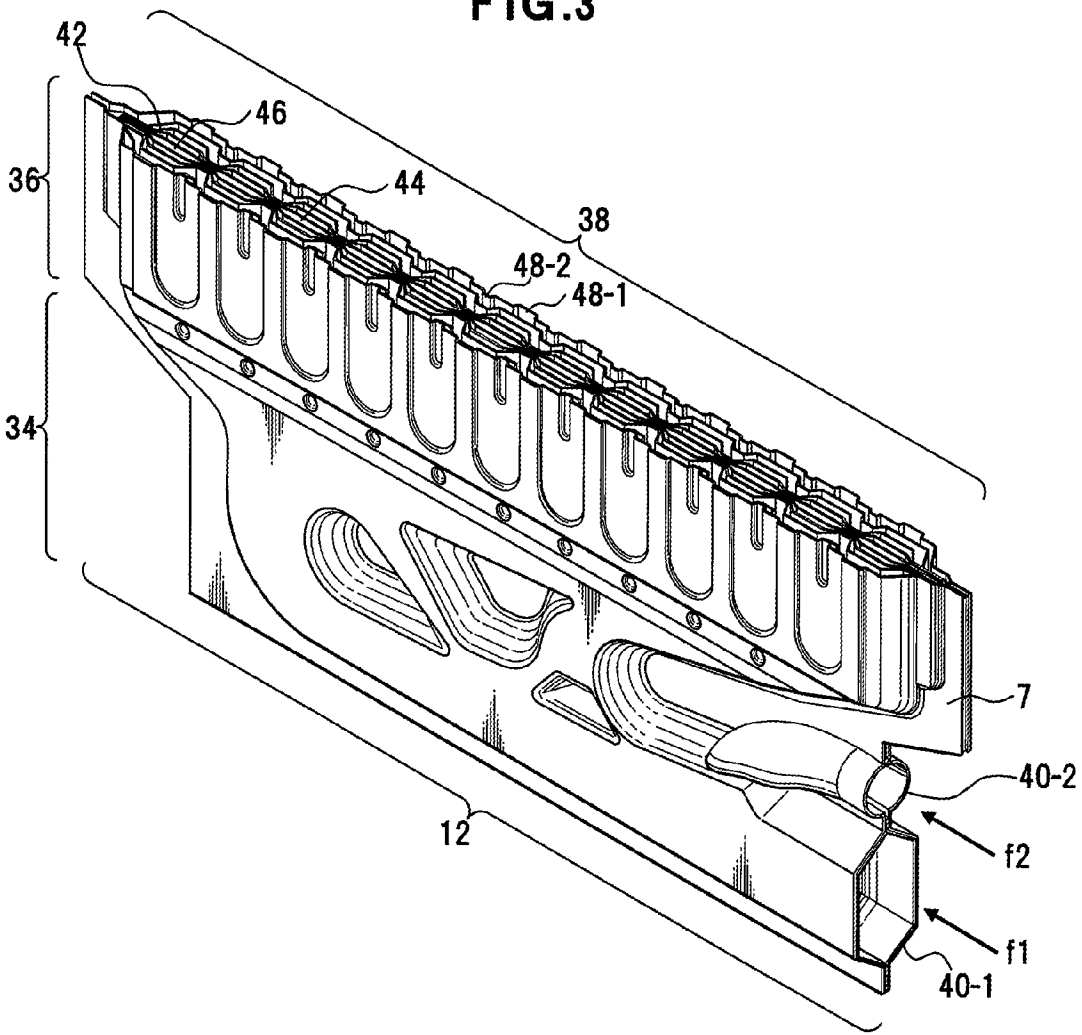
FIG. 3 is a perspective view depicting a burner unit.

FIG. 3 depicts an example of the burner unit 12 in the combustion apparatus 2. The burner unit 12 is an example of the burner of the present invention.

For example, the burner unit 12 is, what is called, a press burner. A heat-resistant metallic plate such as a stainless steel sheet is used for a plate member of this press burner. Thus, this press burner may be shaped by press working of a heat-resistant metallic plate. The burner unit 12 includes a main body 34, a fixing part 36 and the burner ports part 38 in order from the bottom side to the burner ports side. The main body 34, the fixing part 36 and the burner ports part 38 are formed en bloc by the plate member.

Vertically two-tiered air-fuel mixture entrance ports 40-1 and 40-2 are formed and arranged in the main body 34. The air-fuel mixture entrance port 40-1 is an opening of a flat hexagon, a long hole or the like. The air-fuel mixture entrance port 40-1 is coupled to one of the fuel supply ports 16-1 and a lean mixture f1 is entered thereinto. The air-fuel mixture entrance port 40-2 is a circular opening and is coupled to one of the fuel supply ports 16-2, and a rich mixture f2 is entered thereinto.

Figure 4:
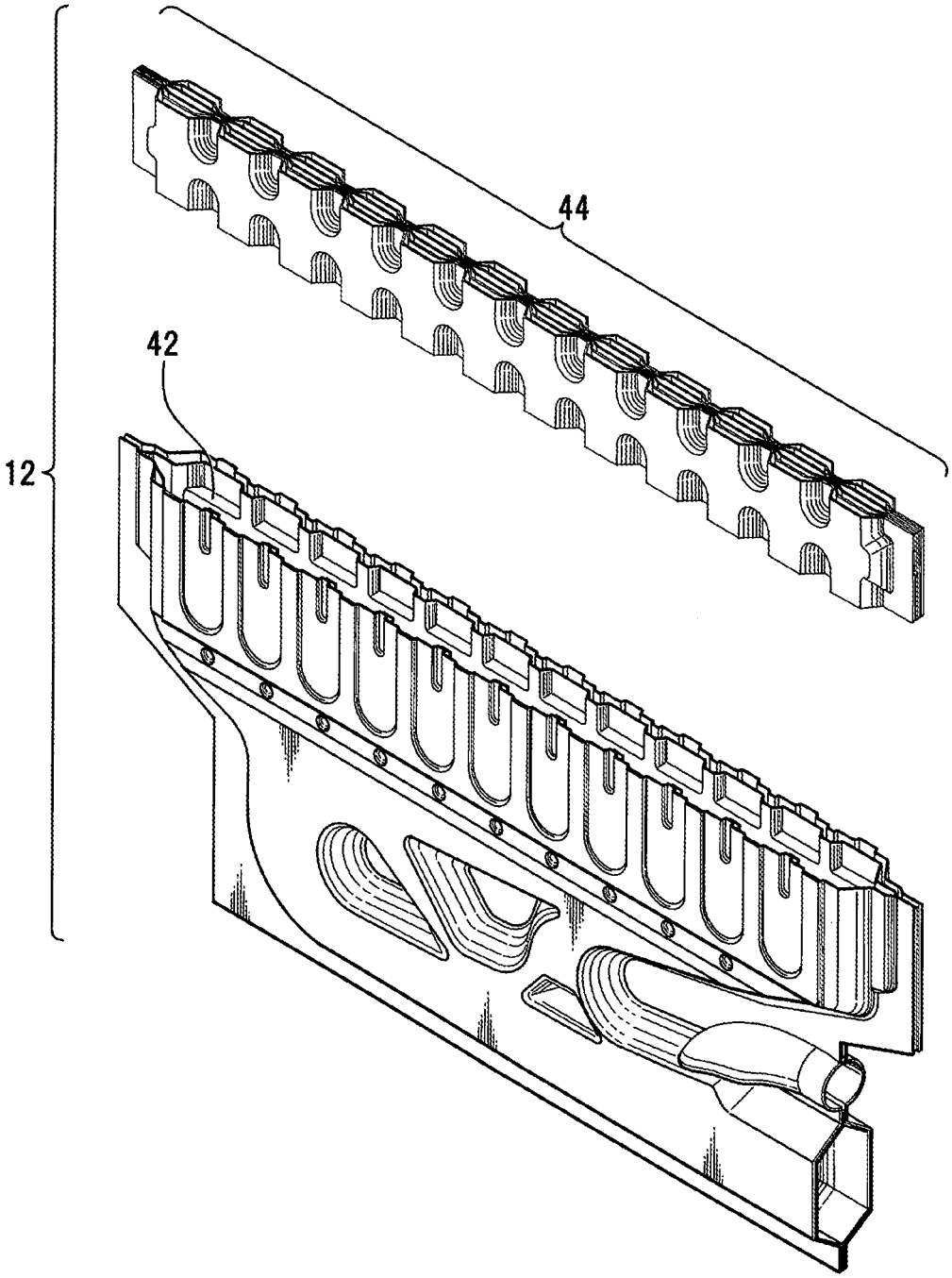
FIG. 4 is a perspective view depicting the burner unit from which a ribbon is separated.

The fixing part 36 fixes the flows of the lean mixture f1 and the rich mixture f2, which are entered into the main body 34, and guides the lean mixture f1 and the rich mixture f2 to the burner ports part 38. A ribbon 44 is displaced in a lean mixture exhaust part 42 of the fixing part 36. The ribbon 44 is an example of a fixing unit that fixes the flow of the lean mixture f1. The ribbon 44 is displaced in the lean mixture exhaust part 42 of the burner unit 12. As depicted in FIG. 4, the ribbon 44 is attachable to and detachable from the lean mixture exhaust part 42 in the burner unit 12.

The burner ports part 38 is formed on the top face of the burner unit 12. The burner ports part 38 has lean flame burner ports 46 at regular intervals as a plurality of the first burner ports that are formed on the top face of the burner unit 12 by the ribbon 44. The burner ports part 38 also has first and second rich flame burner ports 48-1 and 48-2 at regular intervals orderly as a plurality of the second burner ports in the side of the main body 34. In this example, at least one ribbon 44 is formed into the twelve lean flame burner ports 46, and such a ribbon 44 allows the twelve lean flame burner ports 46 to be arranged on the lean mixture exhaust part 42 in line. In the above described combustion apparatus 2, a plurality of the burner units 12 are placed together and thus, the lean flame burner ports 46 are arranged in plural rows and columns, and the burner ports part 38, which makes a uniform surface is formed. The ribbon 44 may be divided into plural parts, and disposed in the lean mixture exhaust part 42.

Edges 50 are formed around the burner unit 12. The edges 50 are formed by adhesion of plate members except those being formed into the air-fuel mixture entrance ports 40-1 and 40-2, the fuel supply ports 16-1 and 16-2, and the burner ports part 38. The edges 50 reinforce the burner unit 12.

Figure 5:
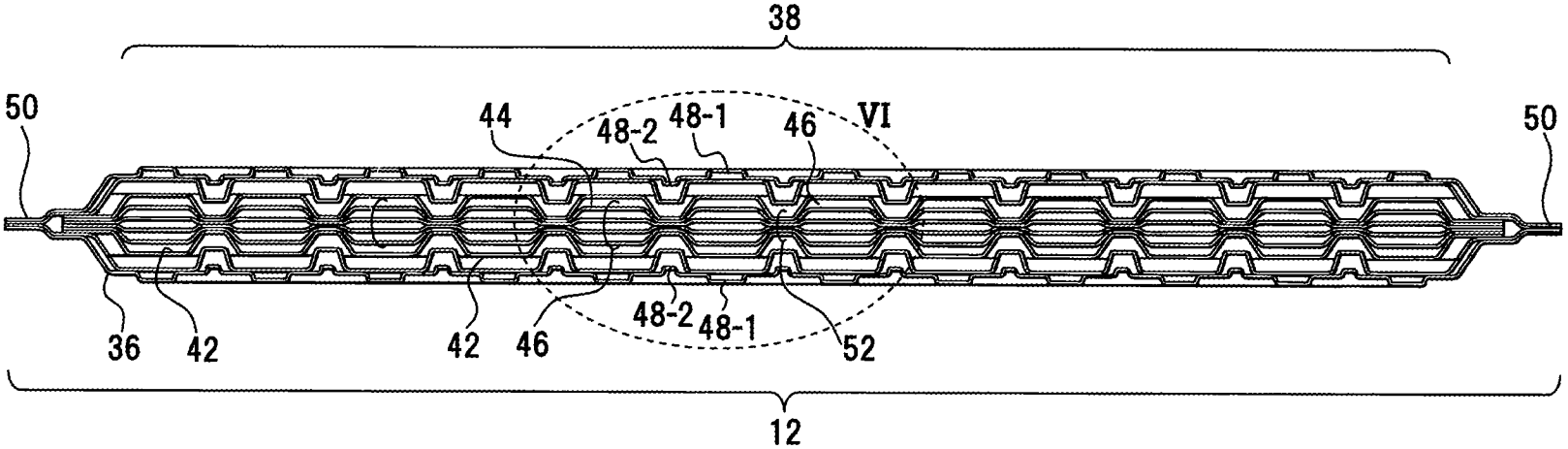
FIG. 5 is a plan view depicting a burner port surface of the burner unit.

FIG. 5 depicts the burner ports part 38. The lean mixture exhaust part 42 is formed in the burner ports part 38 in the longitudinal direction of the burner unit 12. The ribbon 44 is disposed in the lean mixture exhaust part 42. The lean flame burner ports 46 and drawing parts 52 are formed on the ribbon 44 in turn at regular intervals. Thereby, the lean mixture exhaust part 42 is divided into a plurality of the lean flame burner ports 46, which are formed on either side of each drawing part 52. Each lean flame burner port 46 is a shape of a flat hexagon or a long hole, which is an example of a polygonal shape.

The rich flame burner ports 48-1 are formed on either side of each lean flame burner port 46. The rich flame burner ports 48-2 are formed on either side of each drawing part 52.

Figure 6:
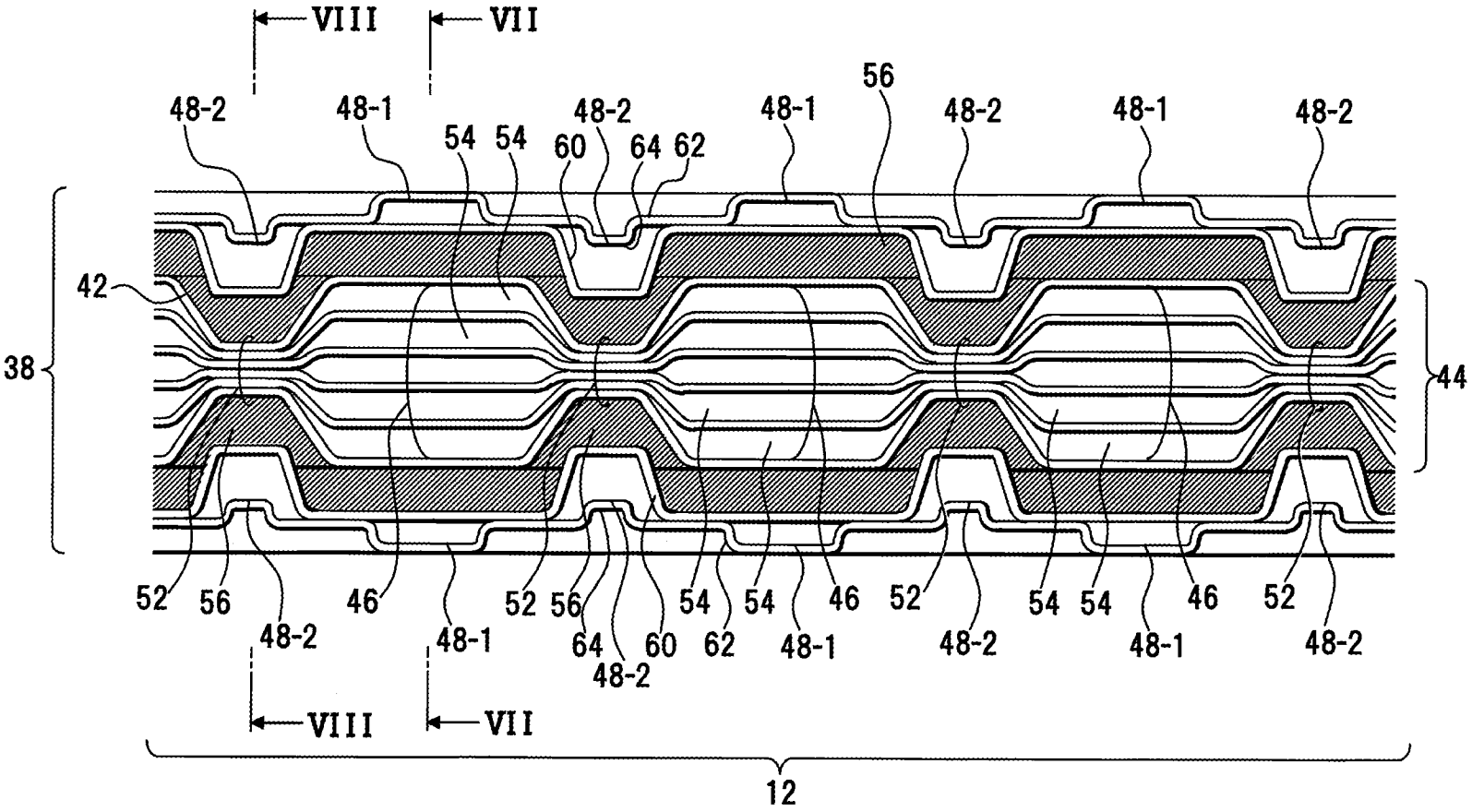
FIG. 6 depicts an enlarged portion VI of FIG. 5.

FIG. 6 depicts an enlarged portion VI of FIG. 5. The portion VI depicts some of the lean flame burner ports 46 and the rich flame burner ports 48-1 and 48-2, which is extracted from the burner ports part 38 of the burner unit 12. This structure is common to the other burner ports parts 38.

A metallic plate such as stainless steel is formed into the ribbon 44 by, for example, press working. In this embodiment, six metallic plates constitute the ribbon 44. The lean flame burner ports 46 and the drawing parts 52 are formed on the ribbon 44 in turn. Each lean flame burner port 46 is formed into five long burner ports 54 as a plurality of small burner ports by differentiating between bending angles of metallic plates, as an example, six metallic plates in the direction orthogonal to that of arranging the lean flame burner ports 46. If the center line is taken in the longitudinal direction of the ribbon 44, the shape of each long burner port 54 has bilateral symmetry with respect to the center line. Formation of such a plurality of long burner ports 54 fixes the flow of the lean mixture f1 to make the flow parallel. Then, the flow is out of the lean flame burner ports 46.

A blocking part 56 is formed around the lean flame burner ports 46 and drawing parts 52 of the ribbon 44. The blocking part 56 blocks the passage of the lean mixture f1. The blocking part 56 is an example of a gap that surrounds the lean flame burner ports 46. In short, a plurality of the burner units 12 each include a first burner unit part that includes the lean flame burner ports 46 and a second burner unit part that includes the rich flame burner ports 48-1 and 48-2. In this case, the blocking part 56 may be made outside the first burner unit part by the second burner unit part. In FIG. 6, the blocking part 56 is shaded to clear where the blocking part 56 is. The blocking part 56 is an isolation area that isolates the lean flame burner ports 46 from the rich flame burner ports 48-1 and 48-2, and also forms a circumscribed area.

A pair of the rich flame burner ports 48-1 is formed respectively on either side of each lean flame burner port 46 outside the blocking part 56 in the middle of the lean flame burner port 46 in the longitudinal direction. The longitudinal width of each rich flame burner port 48-1 is narrower than the width of each long burner port 54 of the lean flame burner port 46. An opening area of each rich flame burner port 48-1 is smaller than that of one long burner port 54. Thereby, the flow rate of the rich mixture f2 that flows out of the rich flame burner ports 48-1 can be set faster than the combustion speed of the rich mixture f2.

A pair of the rich flame burner ports 48-2 is formed respectively on either side of each drawing part 52 in the middle of the drawing part 52 in the longitudinal direction. The rich flame burner ports 48-1 and 48-2 are formed by joining an inner wall plate 60 and an outer wall plate 62, which are formed by a common metallic plate. For example, the inner wall plate 60 is bent like a trapezoid to be protruded toward the drawing part 52. The outer wall plate 62 is bent toward the inside of the rich flame burner port 48-2 as well to protrude a bending part 64. Thereby, the rich flame burner port 48-2 is an approximately trapezoid opening shape. An opening area of the rich flame burner port 48-2 is reduced as much as the bending part 64 of the outer wall plate 62. The rich flame burner port 48-2, which is formed and arranged like the above, is larger than an opening area of the rich flame burner port 48-1. Also, the flow rate of the rich mixture f2 from the rich flame burner port 48-2 is more than that from the rich flame burner port 48-1. Moreover, the rich flame burner port 48-2 protrudes toward the blocking part 56 to be close to the drawing part 52. Thereby, rich flames F2 (FIG. 10) are achieved to be combined as the second flame by the rich mixture f2 that is out of a pair of the rich flame burner ports 48-2. As to the area ratio between the rich flame burner ports 48-1 and 48-2, either the former may be larger or the latter may be larger.

Figure 7:
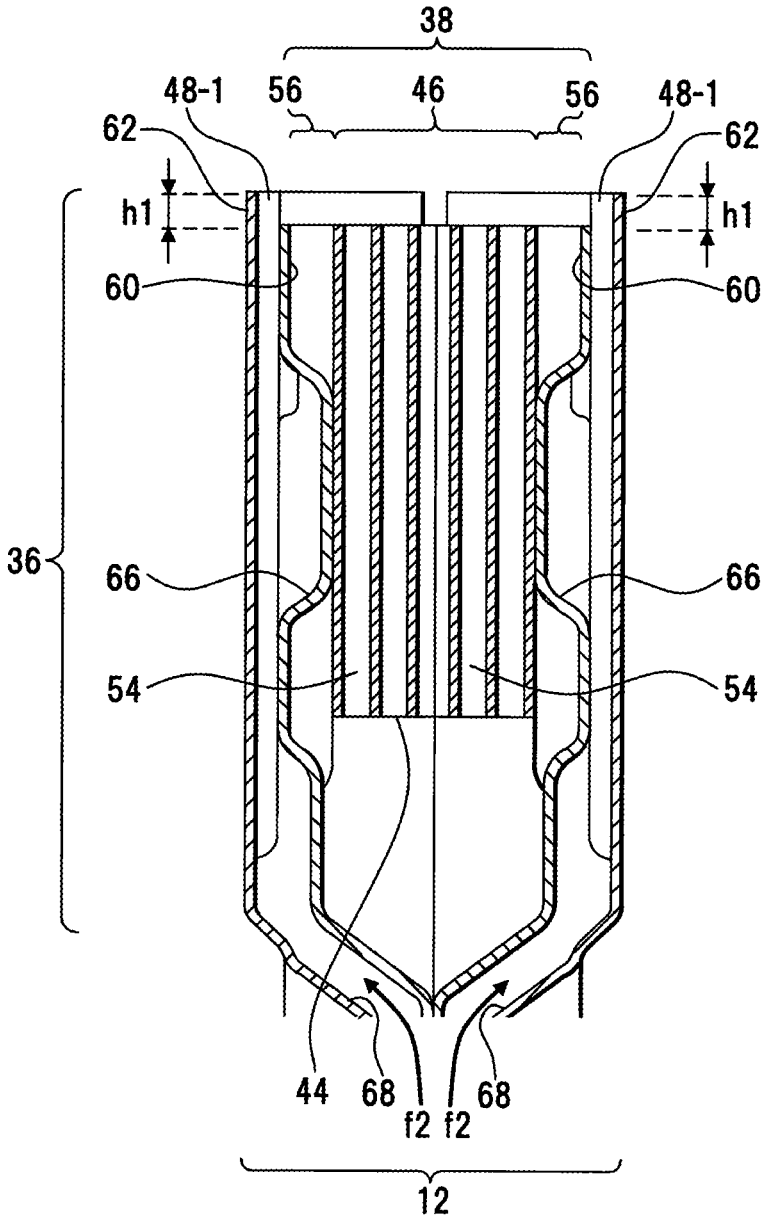
FIG. 7 is an end view depicting an end taken along the line VII-VII of FIG. 6.

FIG. 7 depicts a cross-section taking along the line VII-VII of FIG. 6. On the burner ports part 38 of the burner unit 12, a pair of the blocking parts 56 is formed on either side of the lean flame burner port 46, which is formed by the ribbon 44. The rich flame burner port 48-1 is formed outside each blocking part 56. An opening end of the inner wall plate 60 of the rich flame burner port 48-1 is disposed so as to be the same level of the lean flame burner port 46. In contrast, the outer wall plate 62 is set higher than the inner wall plate 60 by height h1. Thereby, the burner ports part 38 is surrounded by the opening ends of the outer wall plates 62, which are higher by height h1.

Each blocking part 56 is formed by making a protrusion 66 abut on the ribbon 44. The protrusion 66 protrudes from the middle of the inner wall plate 60 toward the ribbon 44.

The rich mixture f2 is guided from the main body 34 via a rich mixture supply paths 68 to the rich flame burner ports 48-1.

Figure 8:
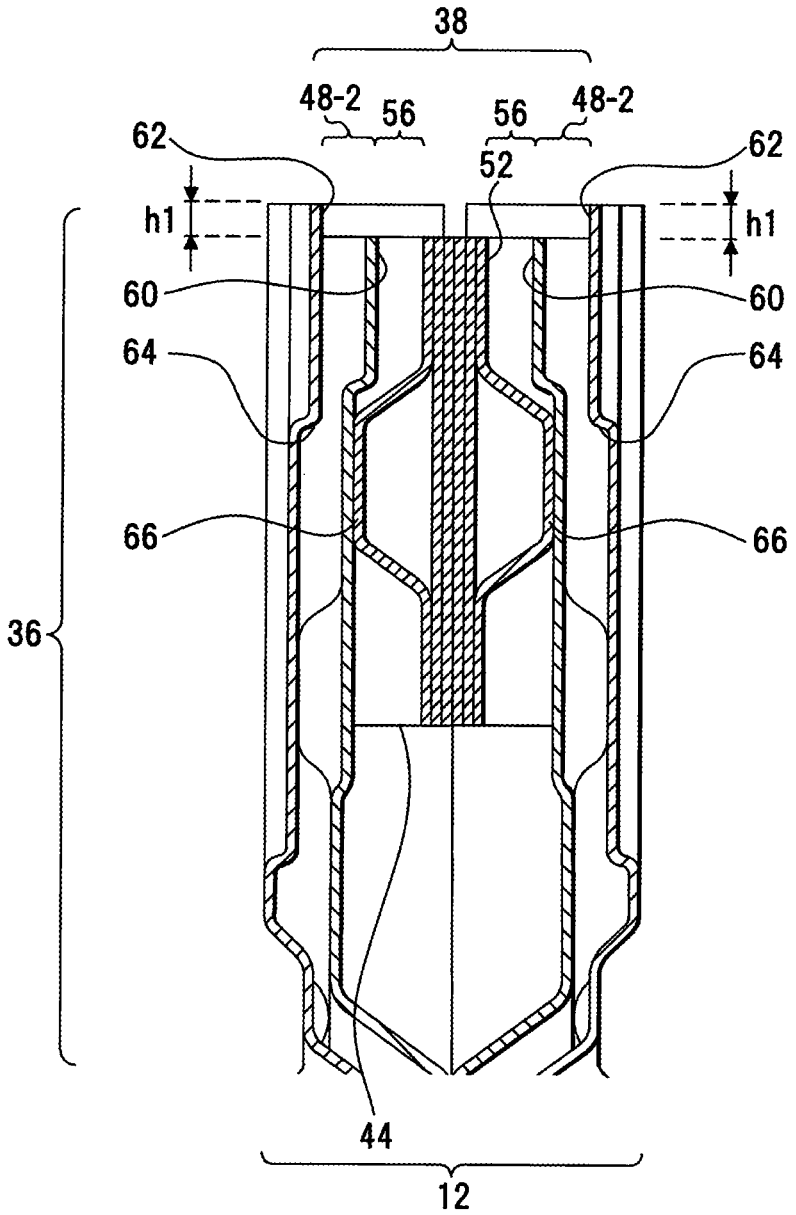
FIG. 8 is an end view depicting an end taken along the line VIII-VIII of FIG. 6.

FIG. 8 depicts a cross-section taking along the line VIII-VIII of FIG. 6. On the burner ports part 38 of the burner unit 12, a pair of the blocking parts 56 is formed on either side of the drawing part 52 of the ribbon 44. Outside the blocking parts 56, a pair of the rich flame burner ports 48-2 is formed.

The protrusions 66 are formed in the middle of the ribbon 44 by bending metallic plates outward. The protrusions 66 abut on the inner wall plates 60. The middles of the inner wall plates 60 protrude toward the drawing part 52 of the ribbon 44. Thereby, the interval where the rich flame burner ports 48-2 face each other is narrowed. Also, the bending parts 64 narrow the opening areas of the rich flame burner ports 48-2. The rich flame burner ports 48-2 are also surrounded by the outer wall plates 62, which are higher by height h1.

Figure 9:
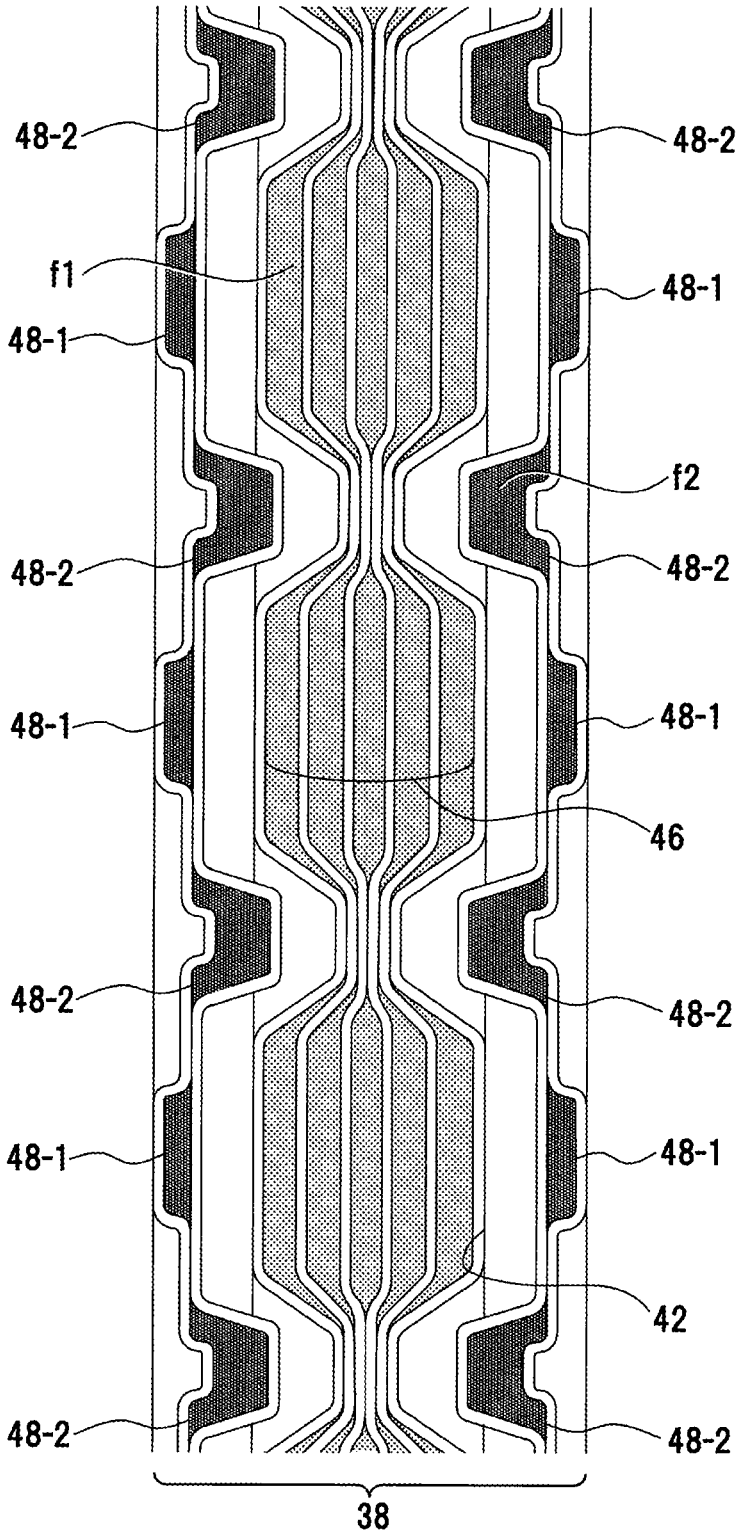
FIG. 9 is a plan view for illustrating outflows of lean mixtures and rich mixtures.

FIG. 9 depicts a pattern of the lean mixture f1 and the rich mixture f2 flowing out of the burner ports part 38 of the burner unit 12. It is possible that the lean mixture f1 flows out of the lean flame burner ports 46 and the rich mixture f2 flows out of the rich flame burner ports 48-1 and 48-2. The volume and the rate of the outflow of the lean mixture f1 are higher than those of the rich mixture f2. The lean mixture f1 that flows out of the lean flame burner ports 46 is surrounded by the rich mixture f2 that flows out of a plurality of the rich flame burner ports 48-1 and 48-2.

<Combustion of Lean Mixture F1 and Rich Mixture f2>

FIG. 10 depicts combustion fields of the lean mixture f1 and the rich mixture f2. If the lean mixture f1 and the rich mixture f2 get into a combustion state from ignition, combustion fields are formed as depicted in FIG. 10. As to the lean mixture f1, a lean flame F1 is generated by the flow rate and the combustion of the lean mixture f1 as the first flame that is independent for each lean flame burner port 46. The lean flame F1, whose horizontal cross section is an ellipse, is formed in this example. This cross section may be a circle.

Pressure in the blocking part 56, which is placed together with the rich flame burner ports 48-1 and 48-2 where the rich mixture f2 jets, is lower than that of the rich mixture f2. Setting of such a relationship of pressure allows the rich flame F2 to go around toward the blocking part 56 without being independent for each rich flame burner port 48-1 and 48-2, and generates the rich flame F2 in response to the supply of secondary air from the lean mixture f1. The rich flames F2 form chaining annular flame that surrounds the lean flame F1, whose horizontal cross section is an ellipse. Thus, the flame F1 is held by the rich flame F2.

Figure 11:
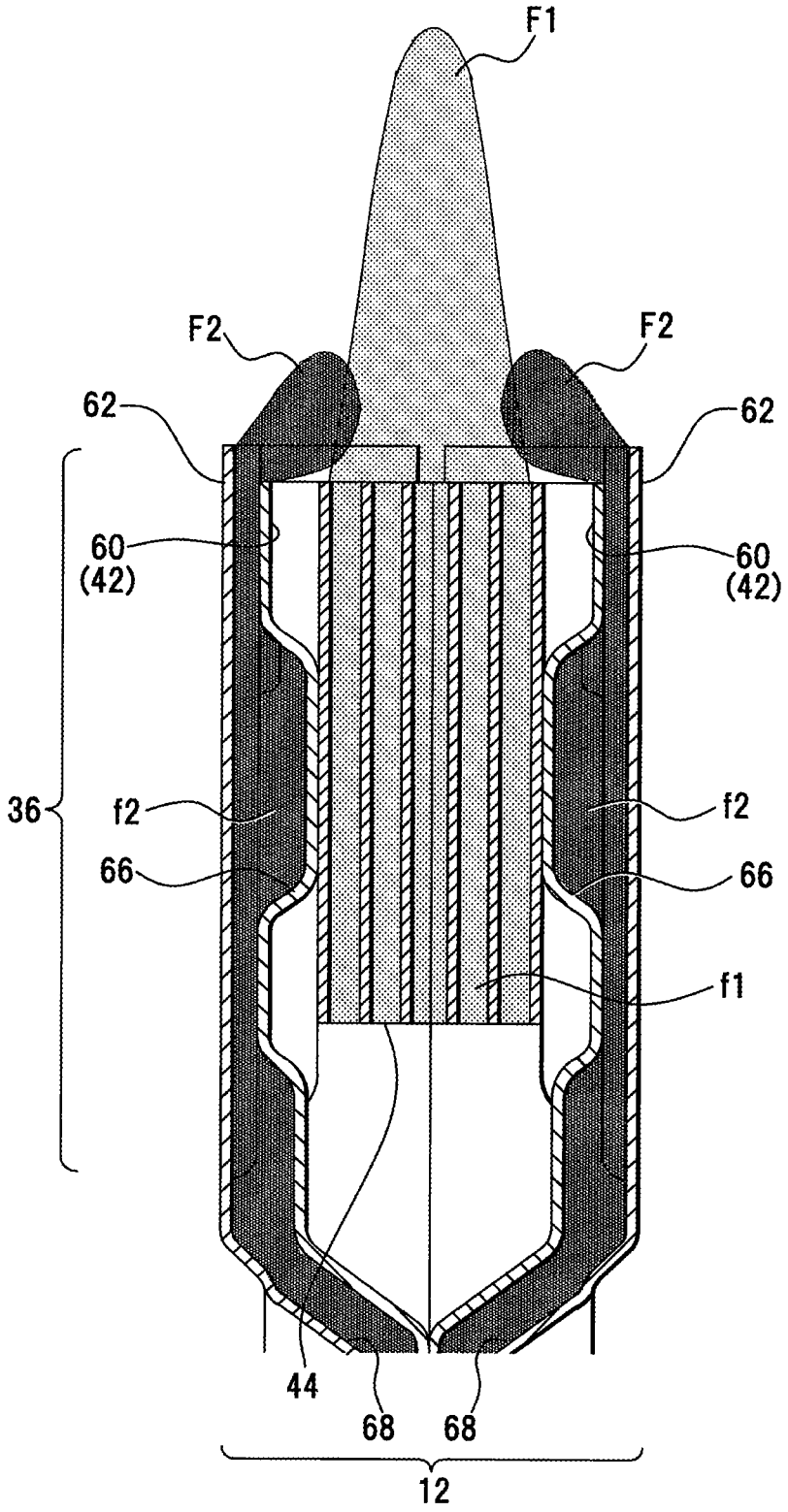
FIG. 11 is an end view depicting a cross-section taken along the line

FIG. 11 depicts a state of the lean flame F1 and rich flame F2 in the cross section taken along the line XI-XI of FIG. 10. A pair of the rich flames F2 is generated on either side of the lean flame F1. In this case, pressure in the blocking part 56, which is between the rich mixture f2 and the lean flame F1, is lower than that of the rich mixture f2. Thereby, the rich mixture f2 goes around toward the blocking part 56. The rich mixture f2 over the blocking part 56 receives the secondary air from the lean mixture f1 that flows near the blocking part 56, to generate the rich flames F2. Thereby, the lean flame F1 is held by the rich flames F2.

FIG. 12 depicts a state of the lean flame F1 and rich flame F2 in the cross section taken along the line XII-XII of FIG. 10. The rich flame F2 is formed at a gap between the lean flames F1. The rich flame F2 grows taller at a location of the rich flame burner port 48-2. Pressure in the blocking part 56, which is adjacent to the rich flame F2, is lower than that of the rich mixture f2. As described above, the rich flame F2 generated by the rich mixture f2 goes around toward the blocking part 56, and then goes around toward the drawing part 52, which is blocked. The middles of the rich flames F2, which go around like this, touch each other in response to the supply of the secondary air from the lean mixture f1 near the drawing part 52 and generate the unified rich flame F2. The rich flames F2 that are formed by the rich flame burner ports 48-2 are surrounded by the outer wall plates 62, to facilitate linking. Thereby, the circumference of the lean flame F1 is surrounded and held by the rich flames F2 in a circled state without gap.

FIG. 13 depicts a state of the lean flame F1 and rich flame F2 in the cross section taken along the line XIII-XIII of FIG. 10. The rich flames F2 are formed by the rich flame burner ports 48-1 and 48-2 for one lean flame F1. Pressure in the blocking part 56 between the rich flame burner ports 48-1 and 48-2 is lower than that of the rich mixture f2. The rich flames F2 go around toward the blocking part 56. The rich flames F2, which go around, touch each other between the rich flame burner ports 48-1 and 48-2 in response to the supply of the secondary air from the lean mixture f1 near the drawing part 52 and the long burner port 54 and generate the unified rich flame F2. The shape of the rich flames F2 form into uneven waves since the rich flame F2 grows taller at locations of the rich flame burner ports 48-1 and 48-2.

FIG. 14 depicts a state of the lean flame F1 and rich flame F2 in the cross section taken along the line XIV-XIV of FIG. 10. While the lean flame F1 is formed for each lean flame burner port 46 independently, the lean flame F1 of all circumference is held by the rich flame F2 that is adjacent thereto because the rich flame F2 exists at the gap between each lean flame F1.

<Amount of Combustion Air (AFR: Air/Fuel Ratio) and Flame Holding by Rich Flame F2>

The relationship between the amount of combustion air per fuel (AFR) and flame holding as to the burner unit 12 is as follows:

(a) Amount of Combustion Air

For example, a gas combustion device whose input kW is 58.1 is assumed to be used with methane as fuel gas. The theoretical amount of air can be calculated from the equation (1):

$$CH_4+2O_2+2\times79/21\times N_2\rightarrow CO_2+2H_2O+2\times79/21\times N_2 \quad (1)$$

$$CH_4+\lambda\times2O_2+\lambda(2\times79/21\times N_2)\rightarrow CO_2+2H_2O+\lambda(2\times79/21\times N_2)+(\lambda-1)\times2O_2 \quad (2)$$

wherein the equation (1) is applied when methane is combusted with the theoretical amount of air and the equation (2) is applied when the air/fuel ratio (λ) is considered. Let the higher heating value of methane be 39.8 (MJ/m$^3$). The flow rate of methane is:

$$58.1\ (\text{kW})/39.8\ (\text{MJ/m}^3)=5.26\ (\text{m}^3/\text{h}) \quad (3)$$

From the equation (1), the theoretical amount of air (λ=1) is;

$$2+2\times79/21=9.52\ (\text{m}^3/\text{m}^3) \quad (4)$$

The theoretical amount of air under 58.1 (kW) is:

$$5.26\ (\text{m}^3/\text{h})\times9.52\ (\text{m}^3/\text{m}^3)=50.3\ (\text{m}^3/\text{h}) \quad (5)$$

In the practical combustion, the amount of air much more than the theoretical amount of air is used in the combustion of lean mixtures in view of the promotion of an oxidation reaction of CO ($CO+1/2O_2\rightarrow CO_2$) and the generation of thermal NOx. Generally, the air/fuel ratio in the combustion of lean mixtures is: $1.3<\lambda<1.6$. Here, when λ is 1.3, the amount of air is calculated as:

$$1.3\times(2+2\times79/21)=12.4\ (\text{m}^3/\text{m}^3) \quad (6)$$

and when λ is 1.3 and input kW is 58.1, the amount of air is:

$$5.26\ (\text{m}^3/\text{h})\times12.4\ (\text{m}^3/\text{m}^3)=65.4\ (\text{m}^3/\text{h})$$

Clearly seen from the equations (5) and (7), if the air/fuel ratio increases, the amount of combustion air increases proportionally to that ratio. As a result, while the rate of the outflow of air-fuel mixtures that are formed by gas and air on the burner ports part 38 increases as well, the stability of flame is determined by balancing with the combustion speed.

In general, the more the amount of combustion air is (the more the air/fuel ratio is), the further away a combustion field is formed from a burner port surface that is in a stable state for flame. Since a flame temperature falls due to the increase of the amount of air, flame gets into more unstable state. If the amount of air further increases, finally flame is blown off to be extinguished.

The burner unit 12 is a rich-lean press burner. Thus, the lean flame F1 is the main flame. Therefore, if the air/fuel ratio of the lean flame F1 is decreased for the stability of the lean flame F1, CO and NOx are generated excessively and the decrease of the air/fuel ratio gets difficult. Then, flame holding by the rich flame F2 is utilized, and the increase of the air/fuel ratio on the lean flame F1 side can be achieved.

Since the rich flame F2 of the burner unit 12 has a high-level flame holding function, the lean flame F1 is stabilized even on a combustion area of the high air/fuel ratio. The generation of CO is limited and the stability on a combustion area of the high air/fuel ratio is achieved.

(b) Combustion Speed

The combustion speed of hydrocarbon, of which methane is a typical example, is closely related to the air/fuel ratio. The combustion speed is the highest when the air/fuel ratio is approaching 1, and is lower when the air/fuel ratio is around 1. Generally, the air/fuel ratio of the lean flame F1 is 1.3 or more. For example, the combustion speed under the air/fuel ratio of 1.3 is within the range of 37 (cm/s) to 18 (cm/s), which is slower compared with that under the air/fuel ratio of 1. In this case, the location where combustion fields are formed is away from a stable burner port surface. Thus, flame is unstable. When $\lambda$ is larger than 1, the more the air/fuel ratio is, the slower the combustion speed is. Thus, it is essential for the lean flame F1 to be held by stable rich mixtures.

<Balance of Rich/Lean Ratio and Shape of Burner Port in Burner Unit 12>

In the burner unit 12, while a conventional shape of a rich flame burner port allows holding the lean flame F1 only in parallel, the rich flame burner ports 48-2 are disposed between the lean flame burner ports 46, the rich flames F2 generate a pseudo-circumferential flame when combustion is carried out to allow holding of the lean flames F1.

Therefore, the area where flames touch each other enlarges in flame holding by the circular rich flame F2 that is formed on the burner unit 12 compared with conventional flame holding where parallel surfaces of flames touch each other. Thereby, efficient flame holding is obtained. This type of flame holding is pseudo-all-circumferential flame holding, and forms the pattern of surrounding the circular lean flame F1 with the annular rich flame F2. Such a pattern is an ideal flame holding pattern.

<Lean Flame F1 and Rich Flame F2>

Generally, the air/fuel ratio of the rich flame F2 is set under one in rich-lean combustion. The combustion load of the rich flame F2 is also set less than that of the lean flame F1. In this case, the rich flame F2 does not form a main flame, but a supplementary flame for keeping a flame. Such a rich flame F2 holds the lean flame F1. The secondary air can be supplied from the lean flame F1 to the rich flame F2. The amounts of CO and NOx that are emitted from the rich flame F2 depends on ways of the supply of the primary air and the secondary air.

In the parallel arrangement of the lean flame F1 and the rich flame F2, the secondary air is supplied enough from the lean flame F1 to the rich flame F2, which is located in the side of the lean flame F1. The rich flame F2, which is away from the lean flame F1, lacks air compared with the rich flame F2 located in the side of the lean flame F1, so that air lacks for such a rich flame F2. Thus, the amounts of CO and NOx emitted from the rich flames F2 get high. If the air/fuel ratio of the rich flame F2 is simply increased, the air/fuel ratio approaches one, thermal NOx is outstandingly generated, and the advantage on rich-lean combustion is damaged. On the contrary, this burner unit 12 offers all-circumferential flame holding, the area where the lean flame F1 touches the rich flame F2 is larger, the secondary air from the lean flame F1 to the rich flame F2 is easy to be supplied, and the reduction of emission of CO and NOx is achieved.

In this burner unit 12, the lean flame F1 constitutes a main flame. The amount of combustion is over several times as much as the rich flame F2. Thus, the area of a burner port of the lean flame F1 is set larger than that of the rich flame F2. It is required to increase the amount of combustion (gas consumption or input), to make the combustion load of the lean flame F1 heavier, and at the same time to get a stable combustion performance although such are limited by a whole area of the burner, which is also limited by, for example, a cost and the design of the size of products.

The lean flame F1 is kept in a state of excess air (air-rich) by reducing thermal NOx through the fall of a combustion flame temperature and by the air/fuel ratio of 1.4 or over, for example. In order to ensure the more amount of heat, the combustion load of the lean flame F1 tends to be heavy, a flame temperature is low from the relationship that the injection velocity of air-fuel mixtures is higher than the combustion speed, the performance of holding and keeping the combustion of the lean flame F1 is poor, and flame-blow-off is easy to be generated.

In rich-lean parallel arrangement of a conventional burner where the lean flame F1, which is located in the side of the rich flame F2, is held by the rich flame F2, the lean flame F1 is always in the vicinity of the top of a burner port to form a stable flame. However, if the lean flame F1 is away from the rich flame F2, only the lean flames F1 hold themselves and the length of the lean flame gets longer. Thus, flame-blow-off and excess CO are easy to be generated. Such a tendency is noticeable when the air/fuel ratio is high or when the rich/lean ratio is extremely low (for example, 20/80 or below). Therefore, the combustion area (air/fuel ratio or combustion load) available is limited in the combustion under such a situation. Pseudo-all-circumferential flame holding occurs in this burner unit 12, and thus, there is no such inconvenience.

When the area of the opening of the lean flame burner port 46 is made to be smaller, the amount of heat per unit area of the common burner ports part 38 is reduced according to the air/fuel ratio or the outflow rate of the lean mixture f1. To increase this amount of heat, either the air/fuel ratio may be reduced or the outflow rate of the lean mixture f1 may be raised.

FIG. 15 depicts the relationship between the rich/lean ratio of combustion gas and CO % in a conventional burner and the burner unit 12, which is the burner of this embodiment. From this relationship, the more the ratio of the lean flame F1 increases, the poorer the performance of holding flames is and the more CO % is in the conventional burner. In contrast, even if the ratio of the lean flame F1 increases, the performance of holding flames is kept and CO % decreases in the burner of this embodiment. Thus, FIG. 15 depicts that the burner of this embodiment enables combustion under a situation where the ratio of the lean flame F1 is high.

FIG. 16 depicts the relationship between the rich/lean ratio of combustion gas and NOx in a conventional burner and the burner unit 12, which is the burner of this embodiment. The more the ratio of the lean flame F1 increases, the less the value of NOx is in both burners. The burner of this embodiment enables combustion under a situation where the ratio of the lean flame F1 is high. It is noted that the shape of the burner ports part 38, which was used for experiments to confirm these relationships, was as illustrated in FIG. 3. The combustion conditions were, for example: input kW was 58.1; and rich/lean ratio (ratio of nozzle diameters) was 20/80.

As is clear from results of the measurement, CO % of the burner unit 12 of this embodiment is lower all over the air/fuel ratio. The rich flame F2 holds all the circumference of the lean flame F1 to make the lean flame F1 form stable flame in the high air/fuel ratio, the length thereof is shortened, and the generation of excess CO is limited. If the flame length extends, an oxidation reaction zone where CO reacts to form $CO_2$ rises. If flame touches, for example, a fin of a heat exchanger before the reaction is terminated, combustion reaction is forcedly finished and excess CO is generated. In the side of the low air/fuel ratio ($\lambda<1.6$), the secondary air from the lean flame F1 is supplied to the rich flame F2 more efficiently in all-circumferential flame holding than in parallel flame holding. Thus, the generation of excess CO is limited. Generally, CO % in the side of the high air/fuel ratio is derived from the lean flame F1 and CO % in the side of the low air/fuel ratio is derived from the rich flame F2.

NOx has a tendency same as CO %. Mainly, NOx is generated on the side of the rich flame F2. The temperature of the rich flame F2 is high (resulting in a source of generating thermal NOx), air tends to lack easily (resulting in a source of generating prompt NOx) as to the rich flame F2, and NOx is generated by the rich flame F2. Thus, NOx emission is affected by how much the secondary air from the lean flame F1 is supplied, in short, by the fall of the temperature of the rich flame F2 and the rise of the rich air/fuel ratio.

Like this, NOx is emitted by the rich flame F2 (it depends on the rich/lean ratio but nearly 80-90% of emitted NOx is by the rich flame F2). However, NOx is also emitted by the lean flame F1. If the lean air/fuel ratio is set in 1.6, NOx is below 10 (ppm) theoretically ($O_2$ is converted into 3%). Even if gas and air are not mixed well on the lean combustion side and the air/fuel ratio of whole the lean combustion is 1.6, NOx from the lean combustion increases when the air/fuel ratio is partially less than 1.2. The performance of mixing air-fuel mixtures, as well as the shape of a burner port, is important for reducing such emission of NOx.

<Balance of Rich/Lean Ratio>

The rich/lean ratio in the rich-lean combustion is determined according to the performance and the object of the burner unit 12. For example, for controlling noise values or for improving the function of preventing oscillated combustion, the setting of increasing the rich/lean ratio (making the load on the rich combustion side heavy) is carried out, and the ratio of the rich flame F2, which is a stable flame, is increased. When toxic exhaust components in exhaust gas such as CO and NOx are desired to be reduced, the setting of reducing the rich/lean ratio is necessary. Lean combustion that is the combustion of the lean mixture f1 is performed closer to the side of the excess air/fuel ratio than rich combustion that is the combustion of the rich mixture f2. Thus, the generation of these toxic components is limited.

The rich/lean ratio is set within the range of, for example, 20/80 to 40/60 in the burner unit 12. In order to prevent combustion noises, for example, 30/70 or over may be set. The rich/lean ratio may be set around 20/80, which is the low rich/lean ratio for ultra low NOx control, for example, for controlling prompt NOx emission from the rich flame F2. However, the setting of the low rich/lean ratio invites a poor performance of flame holding by the rich flame F2 and heavier load for lean flame burner ports. It is predicted that the flame-blow-off of the lean flame F1, oscillated combustion and excess CO occur.

<Effects and Features of First Embodiment>

(1) Combustion Function

The rich flame burner ports 48-1 and 48-2 generate the rich flame F2 to hold the lean flame F1. The rich flame F2 is a stable flame. The rich flame 2 may be used within the tolerance range of CO and NOx, in which the stable flame can be kept. The lean flame burner port 46 generates the lean flame F1, which is a main heat source. The lean flame F1 is an unstable flame. It is essential for the lean flame F1 to be held in the rich combustion on the rich flame burner ports 48-1 and 48-2.

(2) Range of Used Air/Fuel Ratio

The range of the air/fuel ratio used on the side of the rich flame burner ports 48-1 and 48-2 is set as: $0.6<\lambda<0.8$. Air lacks in this setting. The range of the air/fuel ratio used on the side of the lean flame burner port 46 is set as: $1.3<\lambda$. This setting brings excess air.

(3) Stability of Flame

The combustion of the rich flame burner ports 48-1 and 48-2 is very stable, which makes air lack, makes the outflow rate of air-fuel mixtures low, and thus, is well balanced with the combustion speed. The injection velocity is higher than the combustion speed and the flame temperature is low with excess air, and thus flame-blow-off is easy to occur in the lean combustion on the lean flame burner port 46 side.

(4) Pattern of Flame

The injection velocity of the rich combustion on the rich flame burner ports 48-1 and 48-2 is near the combustion speed, and the length of the rich flame F2 is short and the flame is small. The injection velocity of the lean combustion on the lean flame burner port 46 is high and the combustion occurs with the high air/fuel ratio (the combustion speed gets low). Thus, the length of flame is long and the flame is big in the lean combustion.

(5) Generation of CO

The generation of CO can be reduced by the lean combustion on the lean flame burner port 46.

(6) Generation of NOx

If combustion is performed with excess air where $\lambda$ is larger than 1.3, the amount of NOx is below 10 (ppm). The lower the flame temperature is, the less the generation of thermal NOx is.

(7) Back-Fire and Flame-Blow-Off

Back-fire is a phenomenon of flame combustion inside a burner as the flame is passing through a burner port. Flame-blow-off is a phenomenon of flame combustion in a space away from a burner as the flame lifts above the burner contrary to back-fire. Flame-blow-off and back-fire as the above are difficult to be generated in the rich combustion on the rich flame burner ports 48-1 and 48-2.

(8) From the Above, the Following Effects are Obtained According to the Burner Unit 12 of this Embodiment.

a. The flame holding function of a rich flame that is the second flame for a lean flame that is the first flame is improved, to allow the combustion of a lean flame to be achieved to be stabilized, and the reduction of CO and NOx can be achieved by the combustion of a lean flame and a rich flame.

b. The range of the air/fuel ratio available is widened and the air/fuel ratio can be decreased by the reduction of CO and NOx and the stability of the combustion. Thus, the capacity of supplying air of the air supply fan 26 can be controlled.

c. The flame holding function of a rich flame for a lean flame is improved. Thus, the outflow rate of lean mixtures is increased, and the amount of heat generation per unit area is improved in conjunction with the reduction of the air/fuel ratio.

d. The controllability of the combustion is improved, and a compact burner of high output power is achieved.

<Balance of Rich/Lean Ratio (in View of Air/Fuel Ratio)>

Control items for each rich flame burner port 48-1 and 48-2 include, for example, the shape and the area of the burner port. Control items for air-fuel mixtures include, for example, the rich/lean ratio of fuel and the air/fuel ratio. It is necessary for the determination of the rich/lean ratio to take the air/fuel ratio of the rich flame F2 and lean flame F1 into consideration. For example, if the air/fuel ratio on the rich flame burner ports 48-1 and 48-2 is 1 or over, the combustion of the rich flame F2 is similar to that of the lean flame F1. While such a rich flame F2 reduces the emission of CO and NOx (NOx can be reduced if the air/fuel ratio is equal to or over 1.2), the injection velocity of rich mixtures that form the rich flame F2 is increased and the flame temperature is decreased, and flame-blow-off tends to be generated. Consequently, the flame holding function for the lean flame F1 deteriorates. This means that if the rich/lean ratio is balanced, the rich flame F2, where the emission of both CO and NOx is suppressed, can be generated.

All-circumferential flame holding is performed for the lean flame F1 by the rich flame F2 on the rich flame burner ports 48-1 and 48-2. Thus, the air/fuel ratio of the rich flame F2 can be set close to the lean flame F1. Even if the air/fuel ratio of the rich flame F2 is increased and the rich flame F2 itself transits in the state of flame-blow-off, the flame holding function is high. As a result, CO and NOx, which are mainly generated from the rich flame F2, can be reduced. If the air/fuel ratio of the rich flame F2 is set around 1, which is the theoretical amount of air λ, the generation of thermal NOx is striking. Thus, the flame temperature may be such that the speed of generating thermal NOx falls, for example, below 1,800° C., and the air/fuel ratio may be set in 1.2 or over.

<Result of Experiments>

FIGS. 17 and 18 depict the result of actual measurement of combustion exhaust gas (NOx and CO) when the combustion apparatus 2 that includes the burner unit 12 is mounted on a water heater. "A" represents result of the experiments on the combustion apparatus 2 according to the present invention, and "B" represents result of measurement on a conventional burner as a comparison example. The rich/lean ratio is 20/80, and input kW is 58.1.

In the relationship between the air/fuel ratio and NOx, as depicted in FIG. 17, the line of the standard value represents the NOx limit in California, the US, which is one of the most strict emission standards in the world. Although a conventional burner can meet this standard under the high air/fuel ratio, the burner unit 12 can realize NOx emission below the standard value within the wide range of the air/fuel ratio.

In the relationship between the air/fuel ratio and CO %, as depicted in FIG. 18, the line of the standard value represents the limit by ANSI Z21.10.3 (gas-fired water heaters, American National Standards Institute), which is one of the most strict emission standards in the world. It can be seen that CO emission is below this standard within the wide range of the air/fuel ratio using the burner unit 12 as well as the result on NOx. The emission is not below the limit using a conventional burner.

A value around "C" is used as the best air/fuel ratio for a conventional burner. The air/fuel ratio may be lowered as the first step for the above described burner unit 12. When the outflow rate of the lean mixture f1 is increased, the emission rate of CO is also increased. As is clear from the graph of FIG. 18, even if the outflow rate of the lean mixture f1 is increased (the more the air/fuel ratio is, the higher the combustion speed is), CO % is kept certain low values. Thus, the outflow rate of the lean mixture f1 may be increased as the second step. Therefore, the emission of CO, NOx, etc. can be reduced by performing the combination of the first and second steps, or either one of them while the amount of heat of the burner ports part 38 per unit area is being kept or increased.

[Variations of Combustion Apparatus]

(1) The first rich flame burner port 48-1 may be configured by plural flame burner ports as rich flame burner ports 48-11 and 48-12 depicted in FIG. 19A.

(2) The second rich flame burner port 48-2 may be arranged so that its protruding tip abuts on the drawing part 52 of the ribbon 44 as depicted in FIG. 19B. This arrangement makes the rich flames F2 closely adhere, to enable to improve the function of holding the lean flame F1.

(3) In the above embodiment, the shape of the lean flame burner port 46 is a flat hexagon. This shape may be an oval or a circle.

(4) In the above embodiment, the shape of the rich flame burner port 48-1 is a flat rectangle. This shape may be an oval or a circle.

(5) In the above embodiment, the shape of the rich flame burner port 48-2 is a trapezoid. This shape may be an oval or a circle.

(6) Such a configuration may be taken that a third rich flame burner port is formed on the blocking part 56, which is between the rich flame burner ports 48-2 on the above embodiment, to hold lean flame.

Second Embodiment

<Water Heating Apparatus>

FIG. 20 depicts an example of the water heating apparatus according to the second embodiment. Structures depicted in drawings, including the structure depicted in FIG. 20, are examples, and such structures do not limit the present invention. This water heating apparatus 102 is an example of using the above described combustion apparatus 2.

The combustion apparatus 102 includes a housing 104. The housing 104 is equipped with the combustion chamber 6 of the above described combustion apparatus 2. The combustion chamber 6 is also used as a heat exchange housing. The burner 10 that combusts an air-fuel mixture GA is disposed in the combustion chamber 6. The burner 10 combusts the air-fuel mixture GA. The burner 10 is partitioned into a plurality of, for example, five burner units.

A spark plug 112 as an example of an ignition means and a flame rod 114 as an example of a flame detection means are disposed on the top of the burner 10. An igniter 116 is connected to the spark plug 112. The igniter 116 generates sparks from the spark plug 112, to ignite the air-fuel mixture GA of the burner 10. The flame rod 114 detects the presence or absence of combustion through flame detection.

A mixing unit 110 generates the air-fuel mixture GA. The air-fuel mixture GA includes both the lean mixture f1 and the rich mixture f2 as described above. The mixtures f1 and f2 are supplied to the burner 10. The fuel gas G is supplied to the mixing unit 110 of this embodiment via a valve unit 118. Also, air A is supplied thereto via the air supply fan 26. The air supply fan 26 is disposed on the bottom side of the combustion chamber 6. When the air supply fan 26 is rotated, the air A in the housing 104 is taken into the combustion chamber 6. The air A is taken from an air supply part 122 of the housing 104 into the housing 104.

The valve unit 118 allows the fuel gas G, which is supplied to a gas supply path 124, to branch into either any of, or two or more of gas supply paths 126-1, 126-2 and 126-3, to supply that fuel gas to either any of, or two or more of fuel gas injection parts 128-1, 128-2 and 128-3. The valve unit 118 includes a main valve 130, a proportional valve 132 and gas solenoid valves 134-1, 134-2 and 134-3 in order of gas-flow. The main valve 130 switches the state between the supply and block of the fuel gas G. The proportional valve 132 adjusts the supply of the fuel gas G. The gas solenoid valves 134-1, 134-2 and 134-3 correspond to the fuel gas injection parts 128-1, 128-2 and 128-3. When the gas solenoid valve 134-1 is opened, the fuel gas G is supplied to the fuel gas injection part 128-1. When the gas solenoid valve 134-2 is opened, the fuel gas G is supplied to the fuel gas injection part 128-2. When the gas solenoid valve 134-3 is opened, the fuel gas G is supplied to the fuel gas injection part 128-3.

A combustion exhaust gas E generated in the combustion chamber 6 flows from the combustion chamber 6 to an exhaust tube 136. Heat exchange is carried out between the combustion exhaust gas E and clean water W by a heat exchanger 138 that is disposed in the upper part of the combustion chamber 6. The heat exchanger 138 is an example of a heat exchange unit. The combustion exhaust gas E heats the clean water W. The combustion exhaust gas E after the heat exchange is emitted via the exhaust tube 136 to the outside. A thermal fuse 140 is disposed adjacent to the combustion chamber 6.

The clean water W is supplied to the heat exchanger 138 from a water supply line 142. A temperature sensor 144, a water flow sensor 146 and a water flow control valve 148 are disposed in the middle of the water supply line 142. The temperature sensor 144 detects a supply water temperature. The water flow sensor 146 detects the amount of supplied water and whether water is supplied or not. The water flow control valve 148 controls water supply. The water flow sensor 146 in this embodiment is disposed on the water flow control valve 148.

Hot water HW obtained by the heat exchanger 138 is supplied via a hot water supply line 150. A water heating high limit switch 152 and temperature sensors 154 and 156 are disposed in the middle of the hot water supply line 150. The water heating high limit switch 152 stops the supply of the fuel gas G when hot water outgoing temperature from the heat exchanger 138 exceeds the upper limit. The temperature sensor 154 detects the temperature at the exit side of the heat exchanger 138.

A by-pass line 158 is disposed between the water supply line 142 and the hot water supply line 150. A by-pass water control valve 160 is disposed in the middle of the by-pass line 158. The water supply line 142 supplies the clean water W to the hot water supply line 150 via the by-pass line 158 according to open and close of the by-pass water control valve 160. This clean water W is mixed with the hot water HW. The temperature sensor 156 detects the temperature of the hot water HW after mixed with the clean water W.

An electronic circuit board 162 is disposed in the vicinity of the air supply fan 26. A water heating control unit 164 is disposed on the electronic circuit board 162. The water heating control unit 164 controls the combustion of air-fuel mixtures according to a combustion requirement of the air-fuel mixture GA.

<Water Heating Control Unit 164>

FIG. 21 depicts an example of the water heating control unit 164. The water heating control unit 164 is configured by a computer. The water heating control unit 164 is equipped with, and connected via a bus 178 to, a processor 166, a ROM (Read-Only Memory) 168, a RAM (Random-Access Memory) 170 and an input/output (I/O) part 174 as an example.

The processor 166 is configured by a CPU (Central Processing Unit), for example. The processor 166 executes an OS (Operating System) and water heating control program stored in the ROM 168. For executing them, signals detected by the flame rod 114, the temperature sensors 144, 154 and 156 and the water flow sensor 146 are referred. Such function units are controlled by executing them as the main valve 130, the proportional valve 132, the gas solenoid valve 134-1, 134-2 and 134-3, the water flow control valve 148, the by-pass water control valve 160 and the igniter 116. It is not depicted but if a remote-control device for water heating control is connected, the processor 166 also executes the control of transmitting and receiving information to/from such a remote-control device.

The ROM 168 stores an OS and a water heating control program. A recording medium such as a semiconductor memory is used as the ROM 168. A hard disk device may be used as a recording medium.

The RAM 170 configures a work area and a data storage area. A readable and writable recording medium such as a semiconductor memory may be used as the RAM 170. It is not depicted but data may be stored using a nonvolatile memory and such data may be used for control.

The I/O part 174 is used for information input and control output. Information input includes signals detected by the flame rod 114, the temperature sensors 144, 154 and 156 and the water flow sensor 146. Control output includes driving signals and control signals for function units such as the main valve 130, the proportional valve 132, the gas solenoid valves 134-1, 134-2 and 134-3, the water flow control valve 148, the by-pass water control valve 160, the igniter 116 and the air supply fan 26. A display 172, an operation part 176 and the air supply fan 26 are connected to the I/O part 174.

The display 172 is an example of an information presentation means. The display 172 displays a state of water heating control and information such as input information, output information and guidance information as characters or graphically. Operation input is added to the processor 166 via the operation part 176 such as a keyboard.

According to the water heating apparatus 102, hot water is stably supplied by the combustion of the combustion apparatus 2. The effects of the burner 10 have been described above, and the description thereof is omitted.

Aspects and effects of the burner and the combustion apparatus which are extracted from the first and second embodiments are as follows:

In the burner, a plurality of the rich flame burner ports may include first rich flame burner ports that are disposed on either side of each lean flame burner port, and a second rich flame burner port that is disposed in the gap between the lean flame burner ports which are adjacent to each other.

In the burner, a plurality of the rich flame burner ports may include rich flame burner ports that face each other at an interval narrower than the lean flame burner port.

In the burner, the rich flame burner port may protrude toward the gap between the lean flame burner ports which are adjacent to each other.

In the burner, the shape of the lean flame burner port may be any of a polygon, an oval and a circle, to generate a lean combustion surface of the lean flame that is either a circle or an oval, and a annular rich combustion surface may be generated around the lean combustion surface using the rich flame.

In the burner, the rich flame burner port may have an outer wall that is higher than the edge of the lean flame burner port, and the outer wall may guide the rich flame to either the side of the lean flame or the side of the rich flame that faces another lean flame.

According to the combustion apparatus, which is an aspect of the present invention, the combustion apparatus includes a plurality of burner units each of which has a lean flame burner port that generates a lean flame, and a plurality of rich flame burner ports that are disposed around the lean flame burner port and that generate rich flames, wherein the rich flames generated by the rich flame burner ports are linked to each other to surround and hold the lean flame.

According to the combustion method, which is an aspect of the present invention, the combustion method includes combusting a lean mixture using a lean flame burner port to generate a lean flame, combusting a rich mixture using a plurality of rich flame burner ports that are disposed around the lean flame burner port to generate rich flames, and linking the rich flames to surround and hold the lean flame.

The functions and effects of the above described combustion apparatus 2 are listed as follows:

(1) The flame holding function of a rich flame that is the second flame for a lean flame that is the first flame is improved, to allow the combustion of a lean flame to be achieved to be stabilized, and CO and NOx can be reduced by the combustion of a lean flame and a rich flame.

(2) The range of the air/fuel ratio available is widened and the air/fuel ratio can be decreased by the reduction of CO and NOx and the stability of the combustion. Thereby, the capacity of supplying air of a fan or the like can be lowered.

(3) The flame holding function of a rich flame for a lean flame is improved. Thus, the outflow rate of lean mixtures is increased, and the amount of heat generation per unit area can be improved in conjunction with the reduction of the air/fuel ratio.

(4) The controllability of the combustion is improved, and a compact burner of high output power can be achieved.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

According to the burner, combustion apparatus, water heating apparatus and combustion method of the present invention, the flame holding function of a rich/lean burner can be improved, the combustion of high stability can be obtained, and the emission of nitrogen oxides can be reduced. Thus, the present invention is useful.

The above embodiments exemplify a lean mixture as the first mixture and a rich mixture as the second mixture. Such mixtures are not simply limited according to the density of fuel. The rich mixture means a mixture whose air/fuel ratio is lower than the lean mixture. In short, it may be determined by a value of the air/fuel ratio whether a mixture is rich or lean.

What is claimed is:

1. A burner comprising:

a plurality of first burner ports that combust a first air-fuel mixture to generate first flames;

a gap that surrounds the first burner ports; and a plurality of second burner ports that are disposed on either side of the gap, the second burner ports combusting a second air-fuel mixture to generate second flames and hold the first flames, wherein the second burner ports include first pairs of second burner ports and second pairs of second burner ports, each first pair of second burner ports being formed on either side of a corresponding one of the first burner ports, each second pair of second burner ports being formed on either side of a corresponding one of drawing parts formed between the first burner ports, an interval between each second pair of second burner ports being narrower than an interval between each first pair of second burner ports, and wherein the gap blocks a passage of the first air-fuel mixture.

2. The burner of claim 1, wherein the second flames are formed by combustion of the second air-fuel mixture whose air/fuel ratio is lower than the first flames.

3. The burner of claim 1, further comprising:

a first burner unit part that includes the first burner ports; and a second burner unit part that includes the second burner ports, wherein the gap is made outside the first burner unit part by the second burner unit part.

4. The burner of claim 1, wherein each first burner port includes a plurality of small burner ports.

5. The burner of claim 1, further comprising:

a first burner unit part that includes the first burner ports; and a second burner unit part that includes the second burner ports, wherein the gap is formed on the first burner unit part.

6. The burner of claim 1, wherein the interval between each second pair of second burner ports is narrower than a width of each first burner port.

7. The burner of claim 1, wherein a shape of each first burner port is any of a pentagon, an oval and a circle, to generate a lean combustion surface of a corresponding one of the first flames that is either a circle or an oval, and the second burner ports generate an annular flame surface around the lean combustion surface using the second flames.

8. The burner of claim 1, wherein the second pairs of the second burner ports protrude toward the gap between the plurality of the first burner ports that are adjacent to each other.

9. The burner of claim 1, wherein each of the second burner ports includes an outer wall that is higher than an end of each first burner port, the outer wall guiding the second flame to either a side of the first flames or a side of another second flame that faces thereto.

10. A combustion apparatus comprising:

a housing;

a burner that is disposed in the housing; and a mixing unit that differentiates a mixing ratio of air to fuel gas to generate a first air-fuel mixture and a second air-fuel mixture that have different air-fuel ratios, wherein the burner includes:

a plurality of first burner ports that combust the first air-fuel mixture, which is supplied from the mixing unit, to generate first flames;

a gap that surrounds the first burner ports;

a plurality of second burner ports that are disposed on either side of the gap, the second burner ports combusting the second air-fuel mixture, which is supplied from the mixing unit, to generate second flames and hold the first flames, and wherein the second burner ports include first pairs of second burner ports and second pairs of second burner ports, each first pair of second burner ports being formed on either side of a corresponding one of the first burner ports, each second pair of second burner ports being formed on either side of a corresponding one of drawing parts formed between the first burner ports, an interval between each second pair of second burner ports being narrower than an interval between each first pair of second burner ports, and wherein the gap blocks a passage of the first air-fuel mixture.

11. A combustion method comprising:

combusting a first air-fuel mixture using a plurality of first burner ports, to generate first flames;

combusting a second air-fuel mixture using a plurality of second burner ports that are disposed on either side of a gap, to generate second flames, the gap surrounding the first burner ports, the gap blocking a passage of the first air-fuel mixture, the second burner ports including first pairs of second burner ports and second pairs of second burner ports, each first pair of second burner ports being formed on either side of a corresponding one of the first burner ports, each second pair of second burner ports being formed on either side of a corresponding one of drawing parts formed between the first burner ports, an interval between each second pair of second burner ports being narrower than an interval between each first pair of second burner ports; and holding the first flame by the second flames.

12. A water heating apparatus comprising:

a heat exchanging unit that carries out heat exchange between combustion exhaust of a burner and supplied water, the heat exchanging unit supplying hot water using the supplied water, wherein the burner includes:

a plurality of first burner ports that combust a first air-fuel mixture, to generate first flames;

a gap that surrounds the first burner ports;

a plurality of second burner ports that are disposed on either side of the gap, the second burner ports combusting a second air-fuel mixture, to generate second flames and hold the first flames, and wherein the second burner ports include first pairs of second burner ports and second pairs of second burner ports, each first pair of second burner ports being formed on either side of a corresponding one of the first burner ports, each second pair of second burner ports being formed on either side of a corresponding one of drawing parts formed between the first burner ports, an interval between each second pair of second burner ports being narrower than an interval between each first pair of second burner ports, and wherein the gap blocks a passage of the first air-fuel mixture.

* * * * *